US011358754B2

(12) United States Patent
Sill et al.

(10) Patent No.: US 11,358,754 B2
(45) Date of Patent: Jun. 14, 2022

(54) TAMPER-EVIDENT BAG SEAL AND TAMPER-EVIDENT BAGS AND METHODS

(71) Applicant: Inno-Pak, LLC, Delaware, OH (US)

(72) Inventors: Jonathan D. Sill, Delaware, OH (US); Denny V. Tao, Katy, TX (US)

( * ) Notice: Subject to any disclaimer, the term of this patent is extended or adjusted under 35 U.S.C. 154(b) by 0 days.

(21) Appl. No.: 17/032,169

(22) Filed: Sep. 25, 2020

(65) Prior Publication Data

US 2021/0086950 A1 Mar. 25, 2021

Related U.S. Application Data

(60) Provisional application No. 62/905,752, filed on Sep. 25, 2019.

(51) Int. Cl.

| | |
|---|---|
| ***B65D 33/18*** | (2006.01) |
| ***B65D 33/12*** | (2006.01) |
| ***B65D 33/08*** | (2006.01) |

(52) U.S. Cl.

CPC ..... *B65D 33/18* (2013.01); *B65D 33/08* (2013.01); *B65D 33/12* (2013.01); *B65D 2401/15* (2020.05)

(58) Field of Classification Search

CPC ..... B65D 33/18; B65D 33/08; B65D 33/12; B65D 2401/15

USPC ..... 383/5, 78

See application file for complete search history.

(56) References Cited

U.S. PATENT DOCUMENTS

| | | | |
|---|---|---|---|
| 1,410,404 | A | 3/1922 | Haines |
| 1,537,956 | A | 5/1925 | Meyers |
| 1,792,885 | A | 2/1931 | Andrews |
| 2,050,967 | A | 8/1936 | Farmer |
| 2,128,196 | A | 8/1938 | Max |
| 2,149,030 | A | 2/1939 | Arlington |

(Continued)

FOREIGN PATENT DOCUMENTS

| | | | |
|---|---|---|---|
| CN | 2347943 | Y | 11/1999 |
| DE | 2733041 | A1 | 2/1978 |

(Continued)

OTHER PUBLICATIONS

Inno-Pak Handle Cuffs; Announced Aug. 24, 2020 [online]. Site visited [Oct. 20, 2021]. Available from Internet URL: https://www.innopak.com/products/handle-cuffs/.

(Continued)

*Primary Examiner* — Jes F Pascua

(74) *Attorney, Agent, or Firm* — Ward and Smith, P.A.; Ryan K. Simmons

(57) ABSTRACT

A tamper-evident bag seal and tamper-evident bags and methods are disclosed. In one embodiment, the tamper-evident bag seal may be a paper or paperboard panel that folds over the handles of an existing bag and is secured to the sides of the bag. The tamper-evident bag seal includes a perforated fold, seam, or line along that is the mechanism for opening the bag and wherein the perforated fold, seam, or line is also the tamper-evident feature of the bag. In another embodiment, the tamper-evident bag includes a sealable flap for securing the bag in the closed state. In another embodiment, the tamper-evident bag includes a tear-away strip along the sealable flap that is the mechanism for opening the bag and wherein the tear-away strip is also the tamper-evident feature of the bag.

7 Claims, 30 Drawing Sheets

(56) References Cited

U.S. PATENT DOCUMENTS

| | | | | |
|---|---|---|---|---|
| 2,693,836 | A | 11/1954 | Hayes | |
| 2,846,134 | A | 8/1958 | Esber | |
| 2,934,255 | A | 4/1960 | Mcduffie | |
| 3,203,621 | A | 8/1965 | Wright | |
| D205,970 | S | 10/1966 | Leifield | |
| 3,770,188 | A | 11/1973 | Bressickello | |
| D229,485 | S | 12/1973 | Peterson | |
| 3,811,613 | A | 5/1974 | Harrison | |
| D233,083 | S | 10/1974 | Rosa | |
| 4,243,171 | A | 1/1981 | Prin | |
| 4,276,982 | A | 7/1981 | Sibrava et al. | |
| D277,555 | S | 2/1985 | Pattillo | |
| 4,723,300 | A | 2/1988 | Aranow | |
| 4,790,670 | A | 12/1988 | Barbaro | |
| 4,955,981 | A | 9/1990 | Provost | |
| 5,035,515 | A | 7/1991 | Crossman et al. | |
| 5,096,113 | A | 3/1992 | Focke | |
| 5,226,941 | A | 7/1993 | Uibel et al. | |
| D372,864 | S | 8/1996 | Hansen | |
| 5,608,949 | A * | 3/1997 | Cooley | B65D 33/1691 24/30.5 L |
| 5,711,751 | A | 1/1998 | Harmanoglu | |
| 5,824,380 | A | 10/1998 | Hagen | |
| 5,881,432 | A | 3/1999 | Good | |
| D438,797 | S | 3/2001 | Bozlee | |
| D442,085 | S | 5/2001 | Bozlee | |
| 6,286,681 | B1 | 9/2001 | Wilfong et al. | |
| D451,389 | S | 12/2001 | Bozlee | |
| 6,361,209 | B1 | 3/2002 | LaRue et al. | |
| D462,904 | S | 9/2002 | Mellon | |
| D501,134 | S | 1/2005 | Takahashi et al. | |
| D502,872 | S | 3/2005 | Fleming | |
| 6,913,389 | B2 | 7/2005 | Kannankeril et al. | |
| 7,004,632 | B2 | 2/2006 | Hamilton et al. | |
| 7,090,272 | B2 | 8/2006 | Novakovich | |
| 7,427,161 | B2 | 9/2008 | Sill et al. | |
| 8,033,447 | B2 | 10/2011 | Katoh | |
| D739,766 | S | 9/2015 | Glass et al. | |
| 9,434,513 | B2 | 9/2016 | Lux et al. | |
| 9,630,748 | B2 | 4/2017 | Keller | |
| D786,976 | S | 5/2017 | Keating | |
| D801,826 | S | 11/2017 | O'Connor et al. | |
| D811,896 | S | 3/2018 | Wigman et al. | |
| D812,490 | S | 3/2018 | Wigman et al. | |
| D821,223 | S | 6/2018 | Tan | |
| D826,043 | S | 8/2018 | Dacey | |
| D828,763 | S | 9/2018 | Tan | |
| D830,849 | S | 10/2018 | Tan | |
| 10,259,616 | B2 | 4/2019 | Korinek et al. | |
| D860,807 | S | 9/2019 | Sill | |
| 2005/0041894 | A1 | 2/2005 | Hanson | |
| 2005/0047686 | A1 | 3/2005 | Elsaesser | |
| 2006/0045390 | A1 * | 3/2006 | Sill | B65D 33/246 383/6 |
| 2006/0196787 | A1 * | 9/2006 | Lewis | B65D 33/004 206/232 |
| 2007/0292053 | A1 | 12/2007 | Lin et al. | |
| 2013/0315507 | A1 | 11/2013 | Vidal et al. | |
| 2015/0360821 | A1 | 12/2015 | Greenwood et al. | |
| 2017/0166357 | A1 * | 6/2017 | Chandaria | B65B 61/14 |
| 2019/0112116 | A1 | 4/2019 | Su et al. | |
| 2021/0086950 | A1 | 3/2021 | Sill | |

FOREIGN PATENT DOCUMENTS

| | | | | |
|---|---|---|---|---|
| DE | 29500157 | U1 | 2/1995 | |
| DE | 19831584 | A1 | 1/2000 | |
| DE | 10-2009-007985 | A1 | 2/2010 | |
| EP | 0515086 | A1 | 11/1992 | |
| FR | 2838406 | A1 * | 10/2003 | B65D 33/1691 |
| GB | 487330 | A | 6/1938 | |
| JP | 2017-061324 | A | 3/2017 | |
| NL | 1040069 | C2 * | 8/2014 | B65D 33/1691 |
| WO | WO2004071890 | A1 | 8/2004 | |

OTHER PUBLICATIONS

International Search Report and Written Opinion from International Application No. PCT/US2019/030891, dated Jul. 26, 2019, 13 pages.

* cited by examiner

TAMPER-EVIDENT BAG SEAL AND TAMPER-EVIDENT BAGS AND METHODS

RELATED APPLICATIONS

This application claims priority and is related to U.S. Provisional Patent Application Ser. No. 62/905,752 entitled "Tamper-Evident Bag Seal and Tamper-Evident Bags and Methods," filed Sep. 25, 2019, the contents of which are incorporated herein by reference in its entirety.

TECHNICAL FIELD

The presently disclosed subject matter relates generally to secure containers and more particularly to a tamper-evident bag seal and tamper-evident bags and methods.

BACKGROUND

Disposable containers for packaging, distributing, displaying or otherwise housing consumer items, such as food containers, are becoming increasingly important. For example, bags, such as paper bags, are used for distributing and/or carrying food items, such as take out or to-go food containers. Sometimes it is desirable that an item or items, such as food containers, be placed in, for example, a bag for ease of transport. Unfortunately, it is a frequent occurrence that the containers may be tampered with by persons who wish to access the item or items in the containers. In taking steps to avoid this invasion of the container, many approaches in the nature of security and/or safety have been utilized. However, some of these security attempts have been easily circumvented and others have been very expensive.

One of the desirable features of security packaging is the characteristic that any tampering with the package produces a "tamper-evident" condition. With a "tamper-evident" condition, a consumer can visually detect that the container has been tampered. Unfortunately, many security attempts have been unsuccessful in that it is not fully evident that the security of the container has been breached. Consequently, new approaches are needed for incorporating tamper-evident features into containers.

BRIEF DESCRIPTION OF THE DRAWINGS

Figure 1:
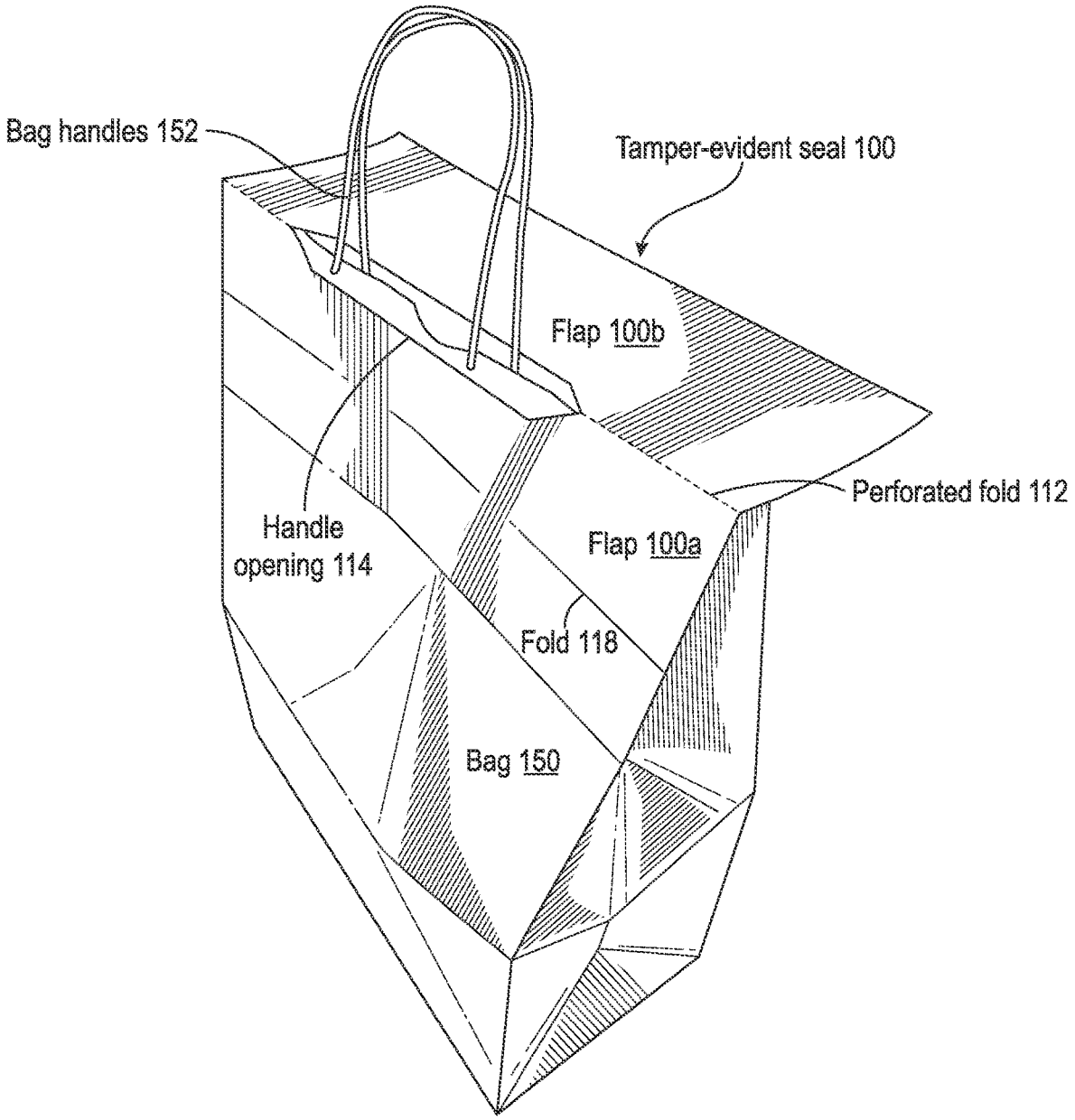
Figure 2:
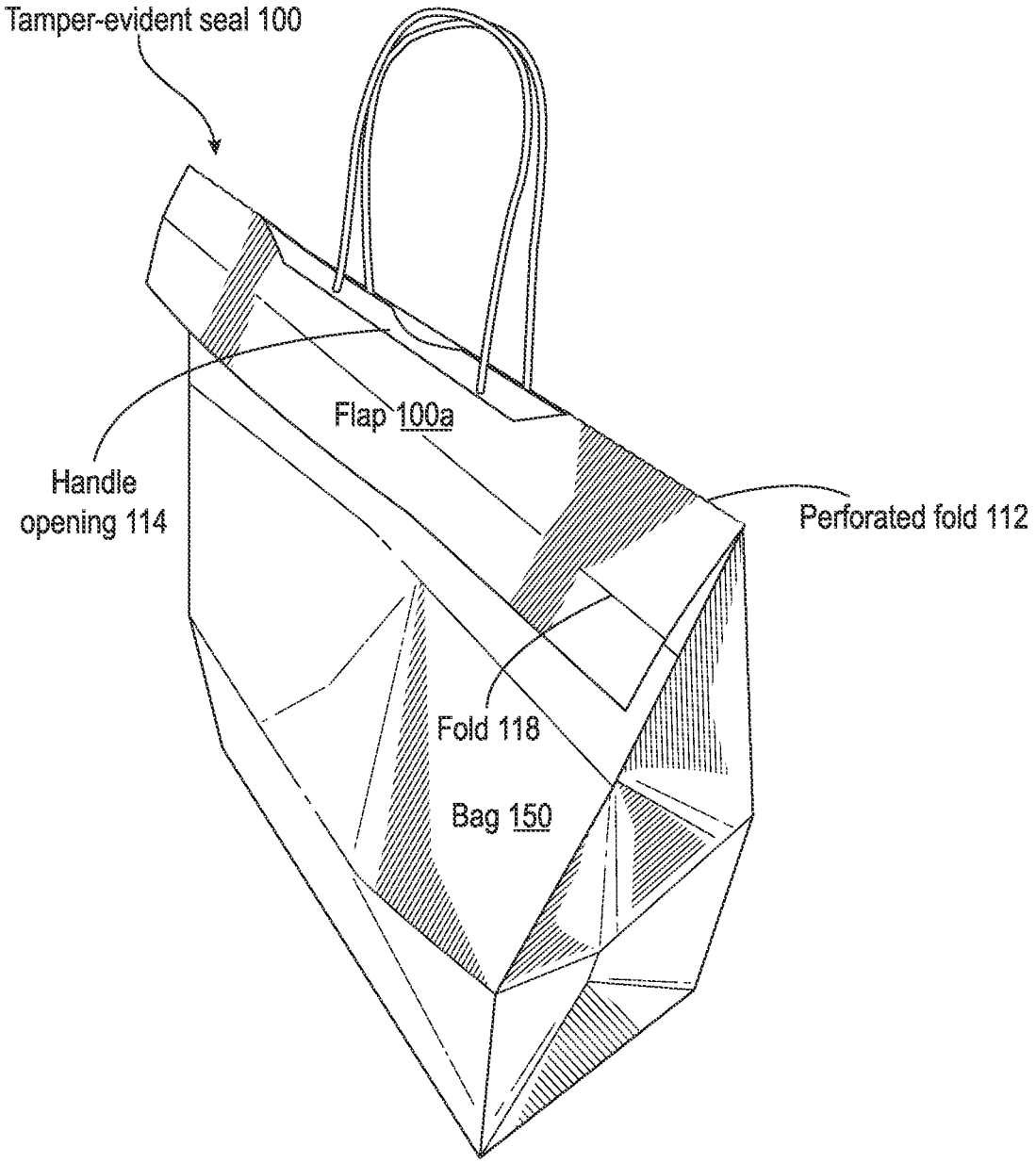
Figure 3:
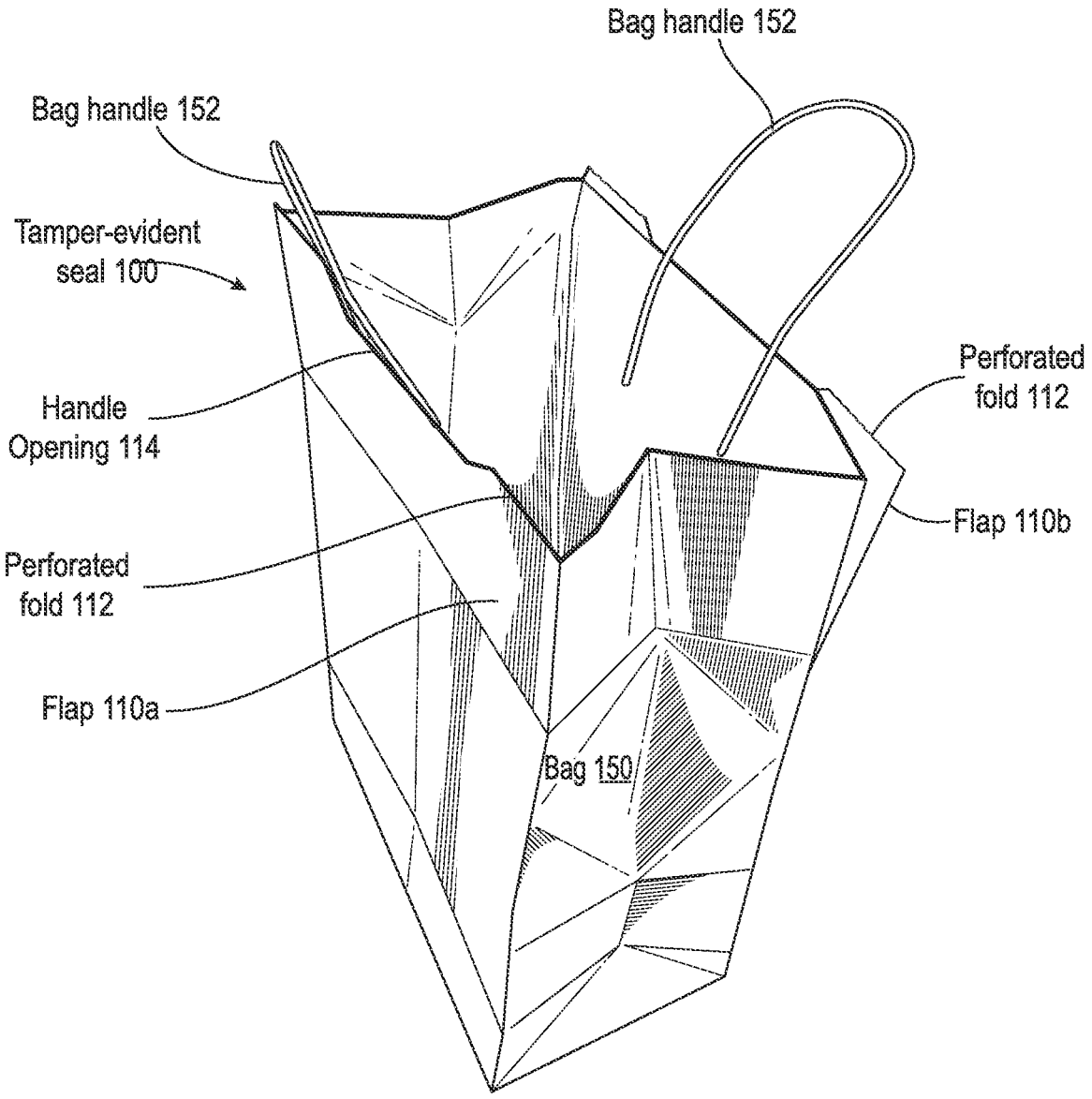
Figure 4:
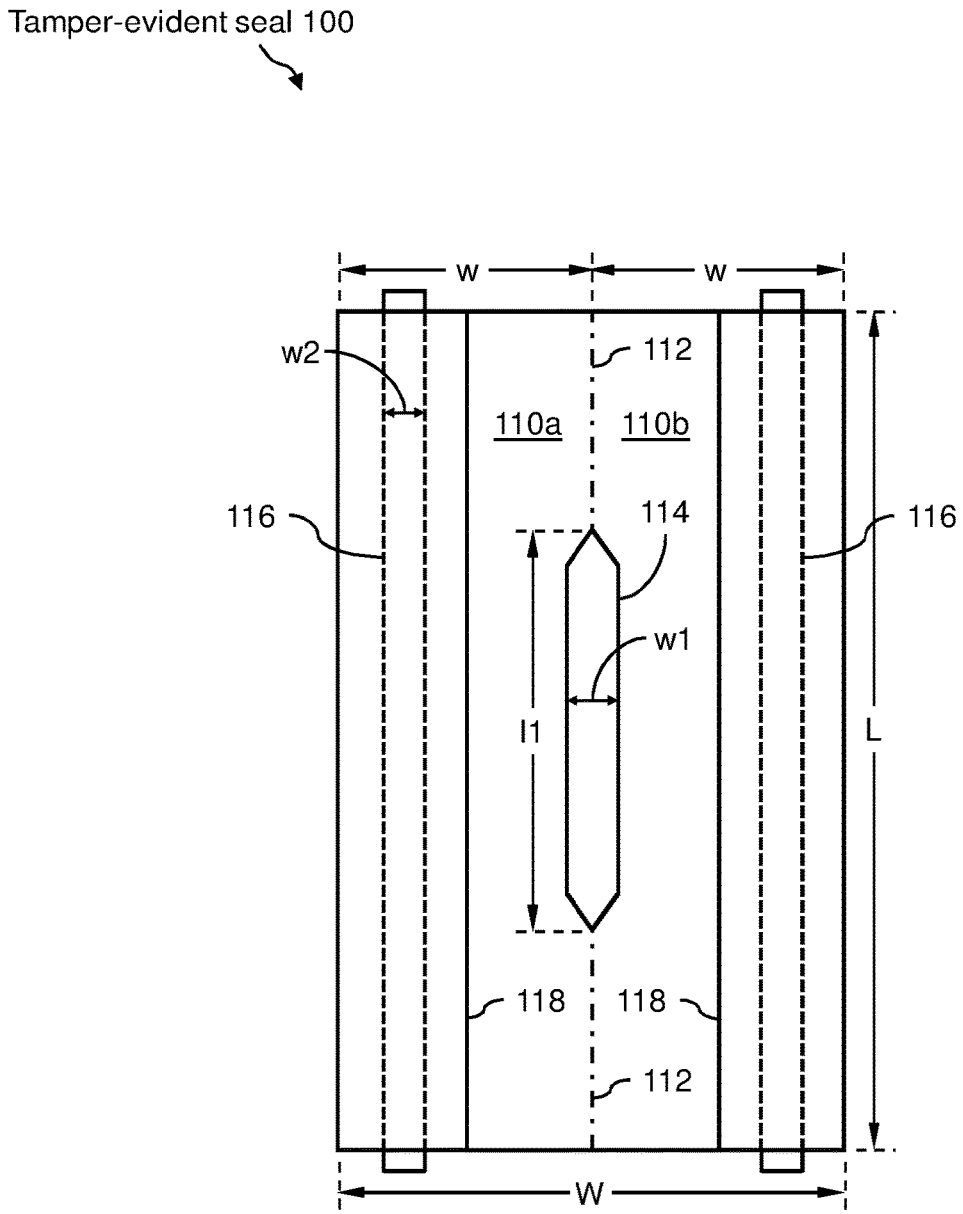
Figure 5:
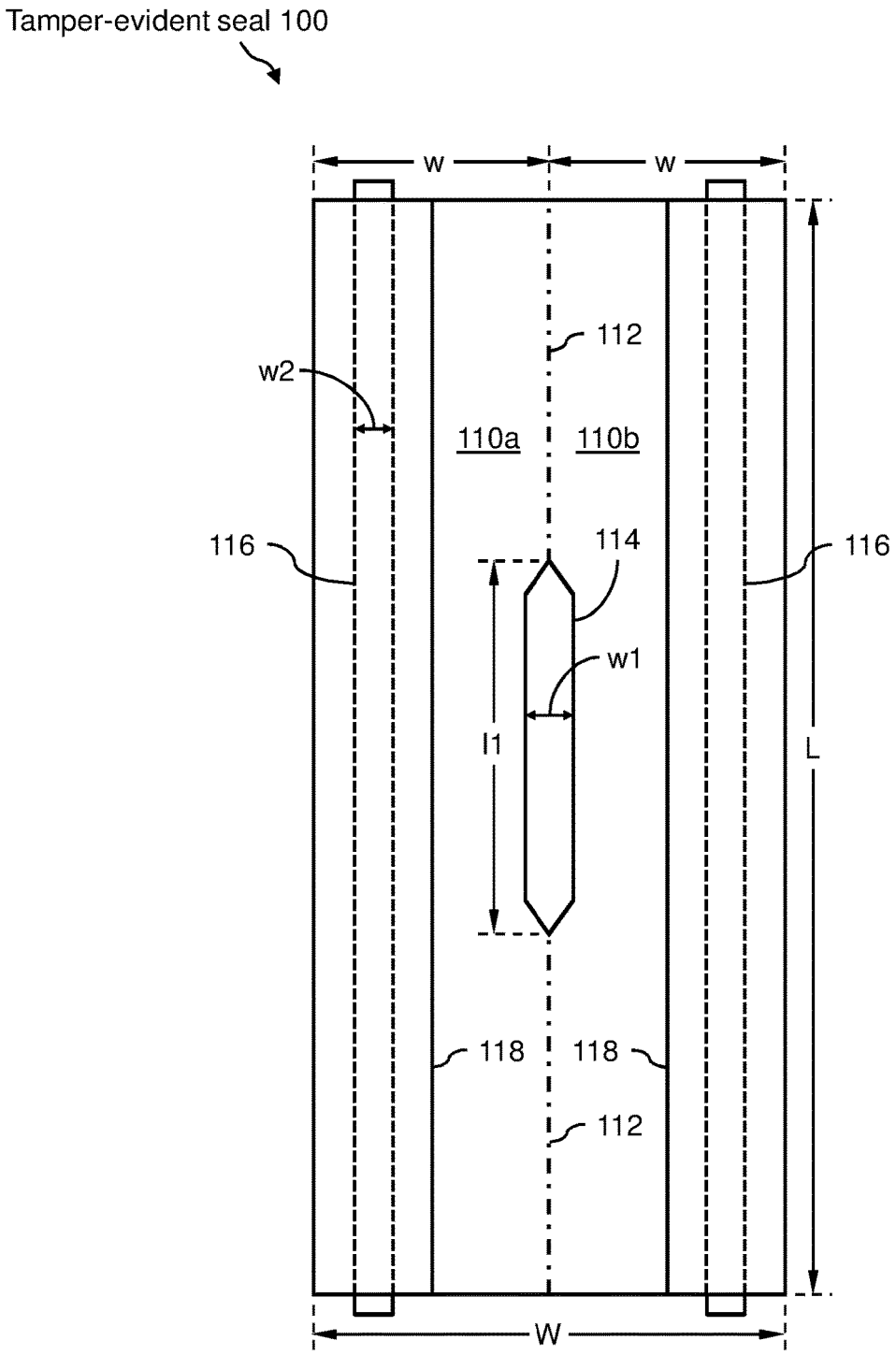
Figure 6:
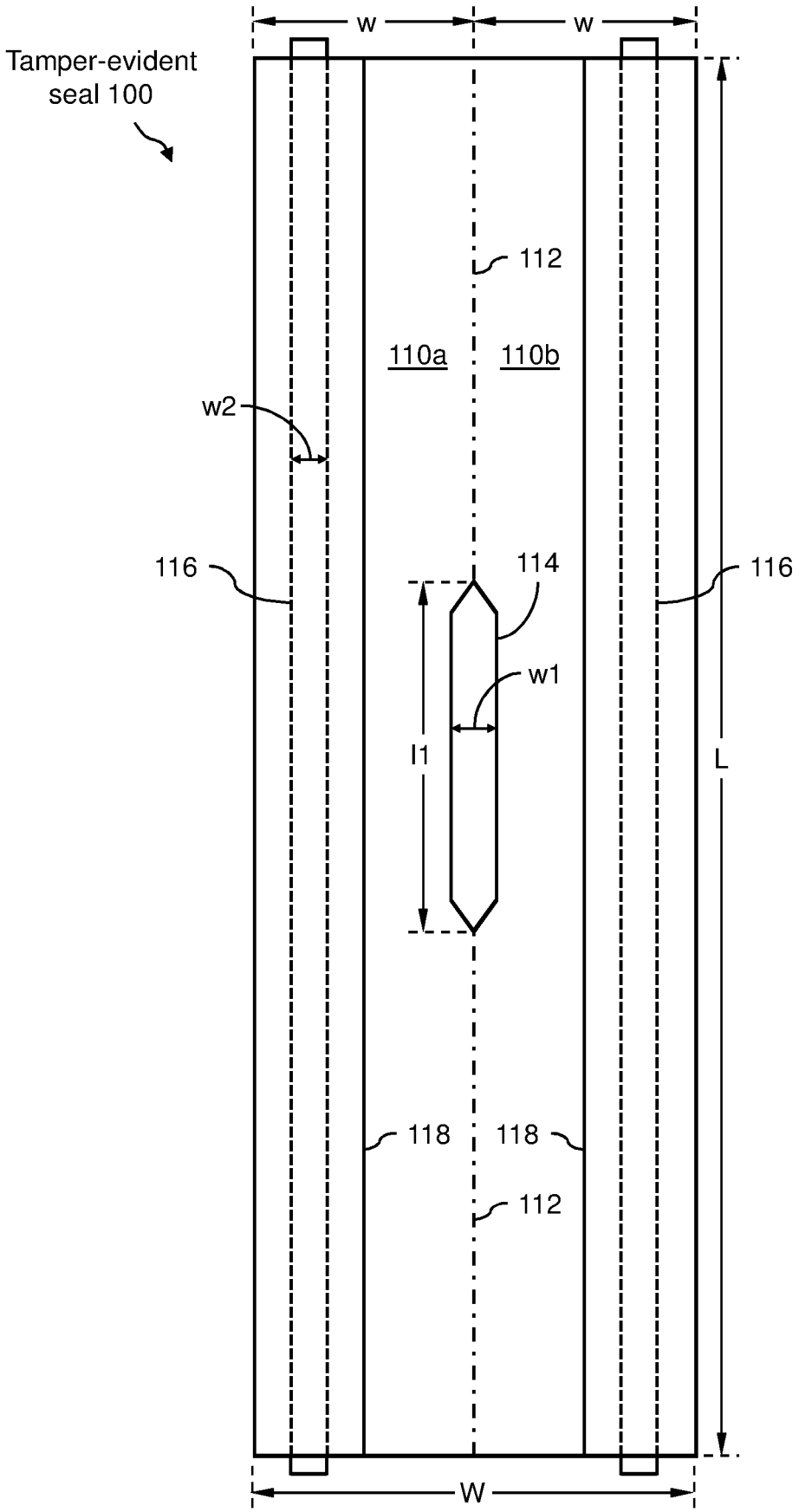
Figure 7:
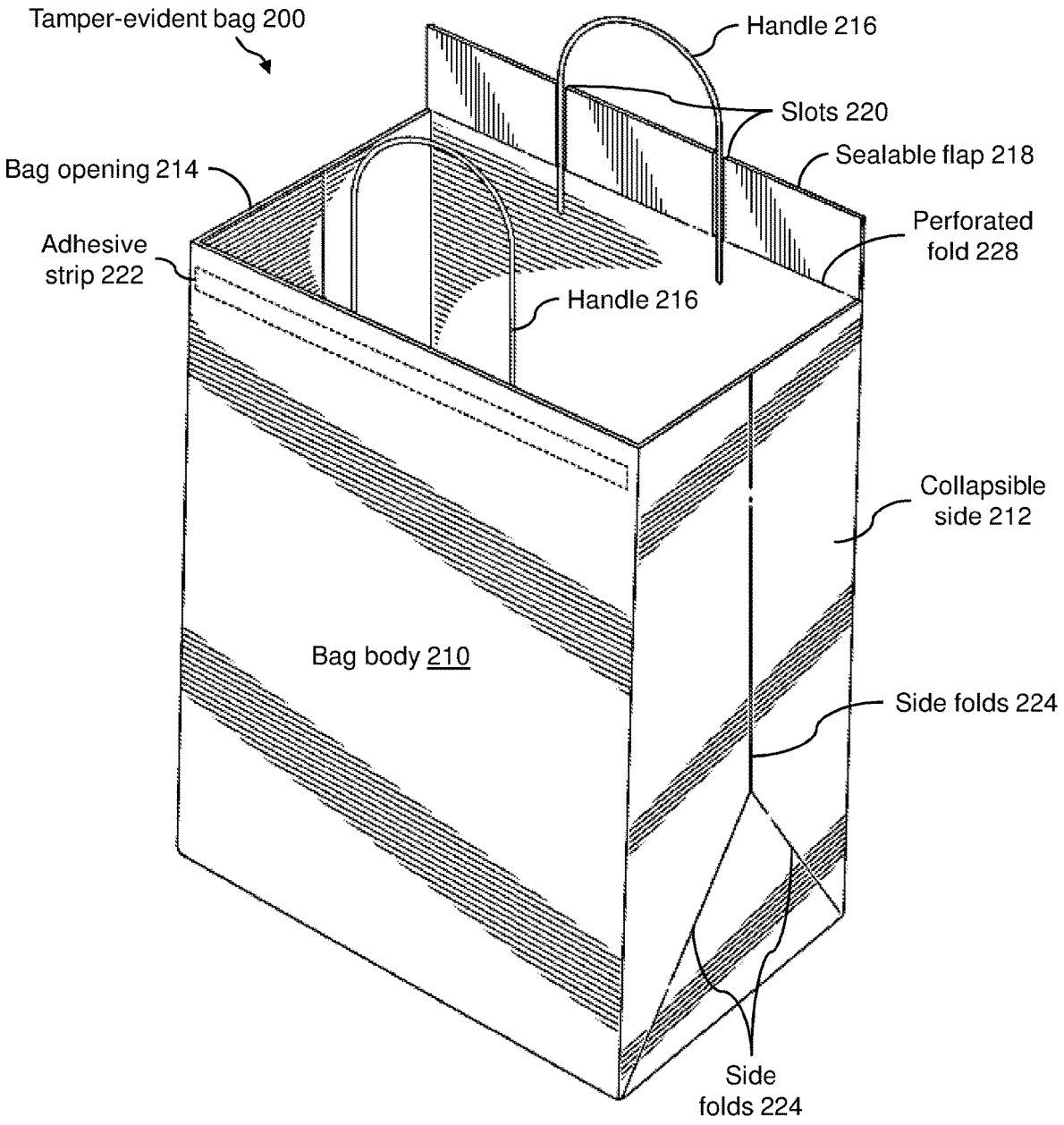
Figure 8:
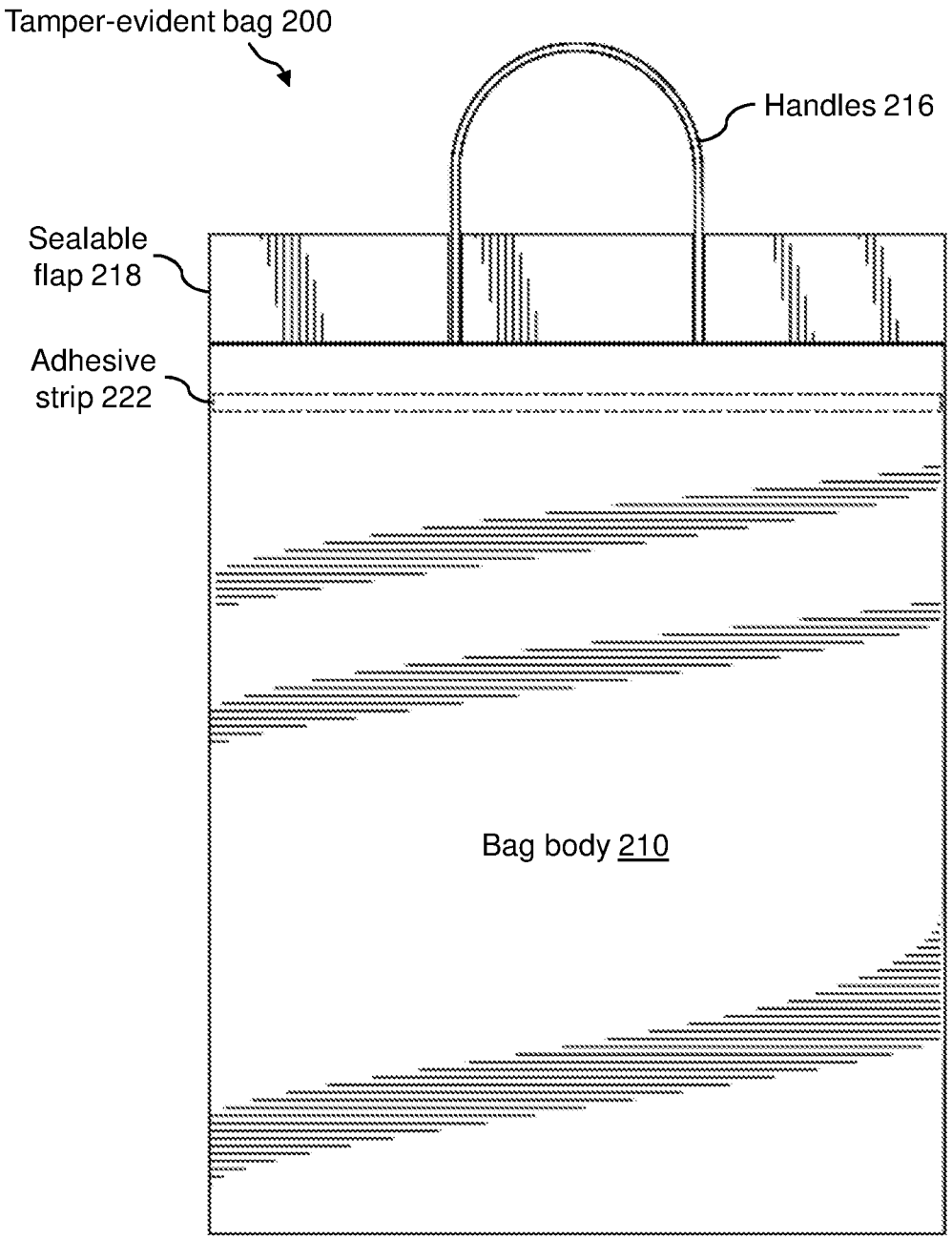
Figure 9:
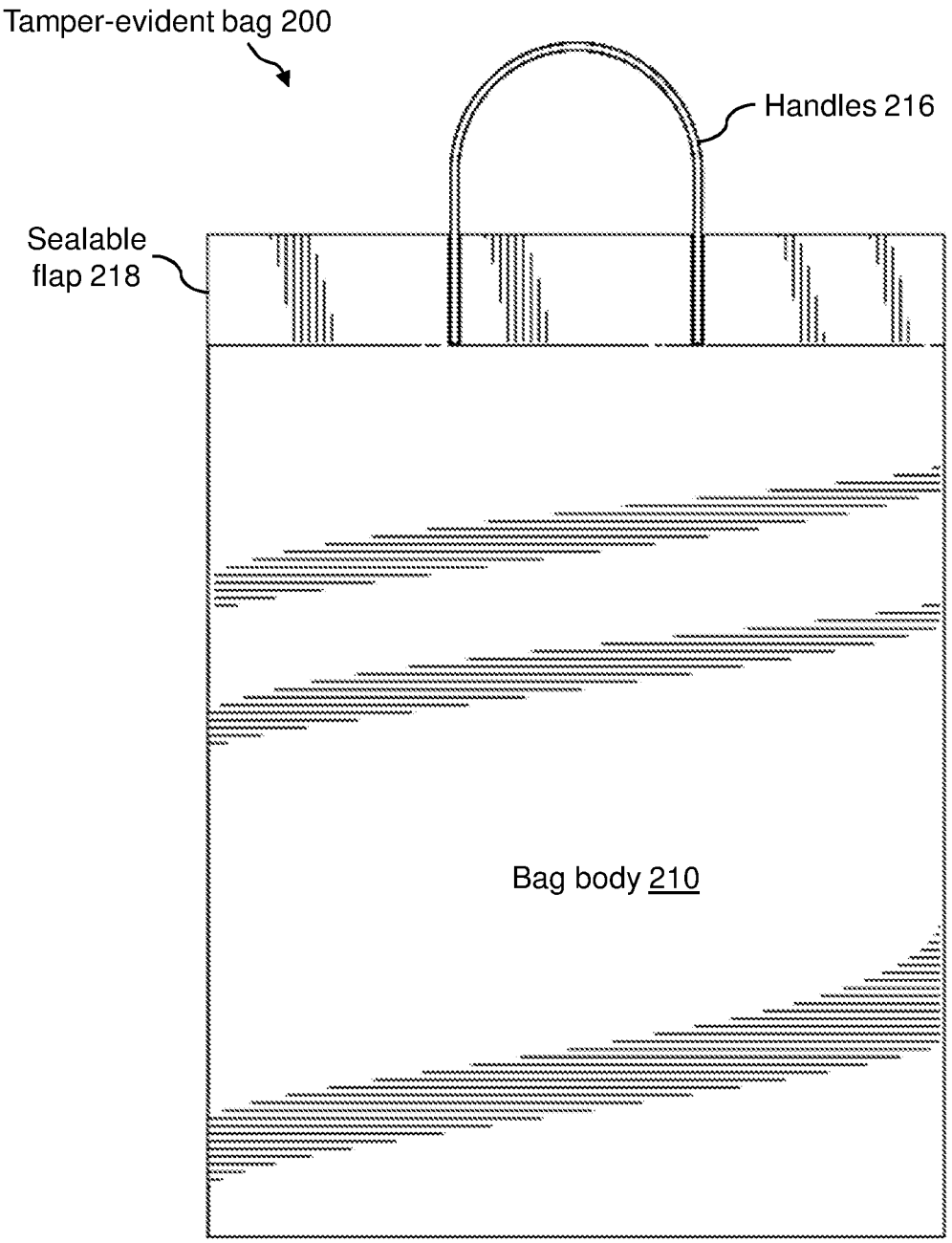
Figures 10, 11:
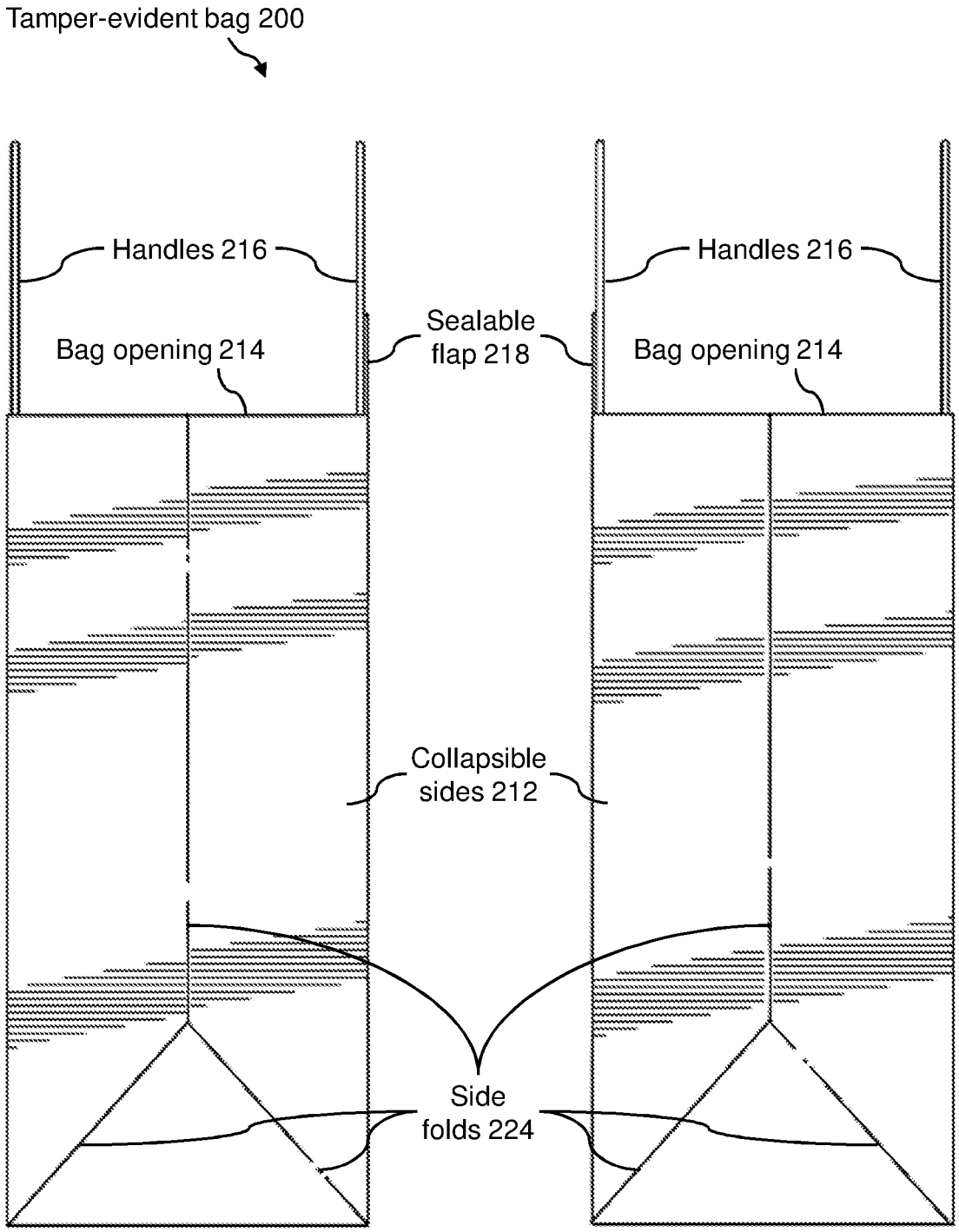
Figure 12:
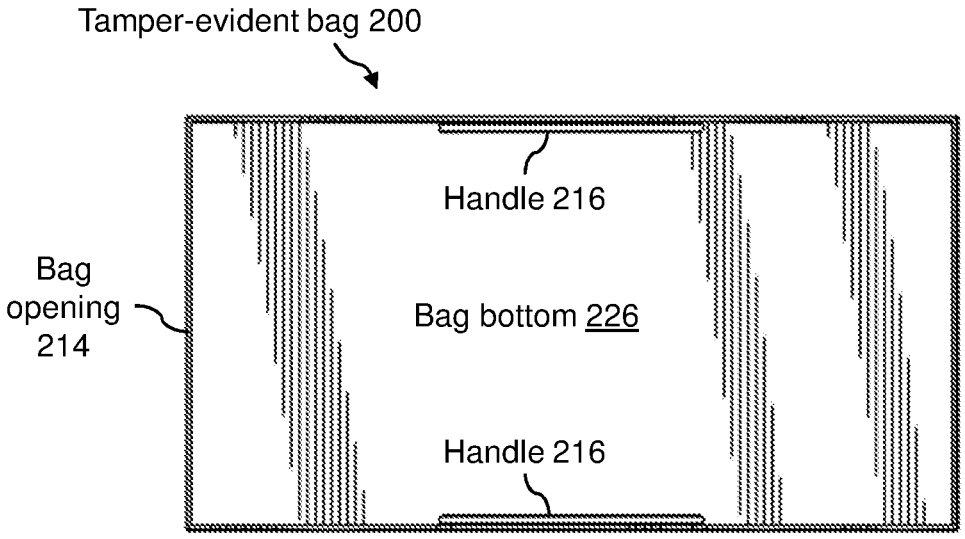
Figure 13:
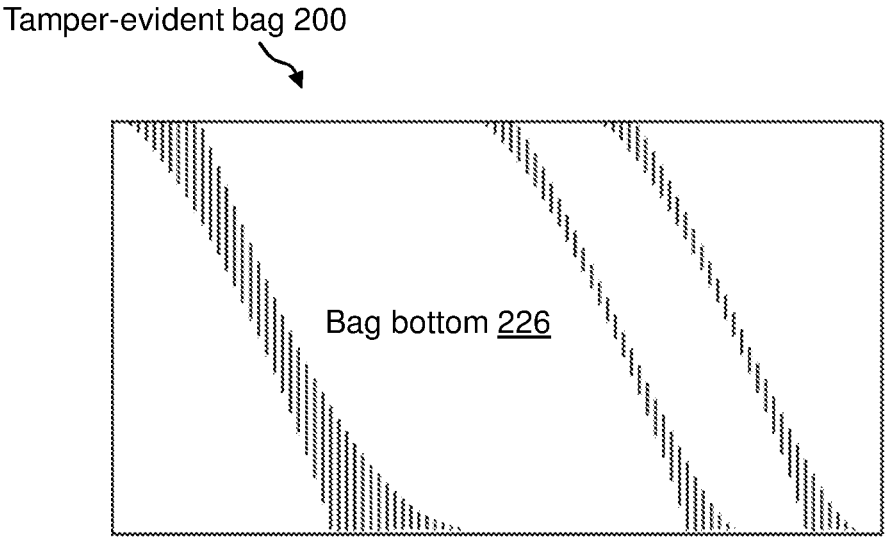
Figure 14:
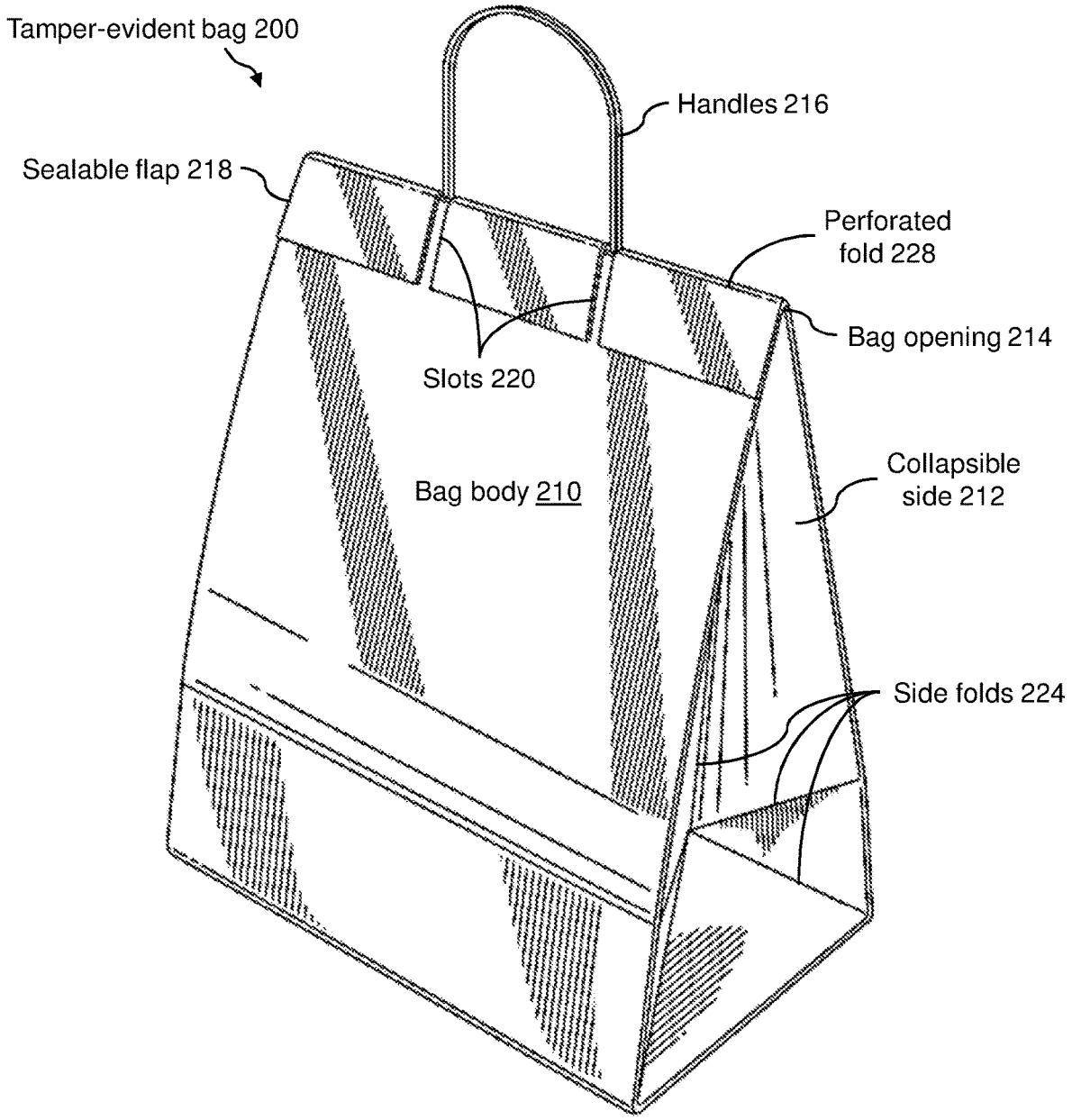
Figure 15:
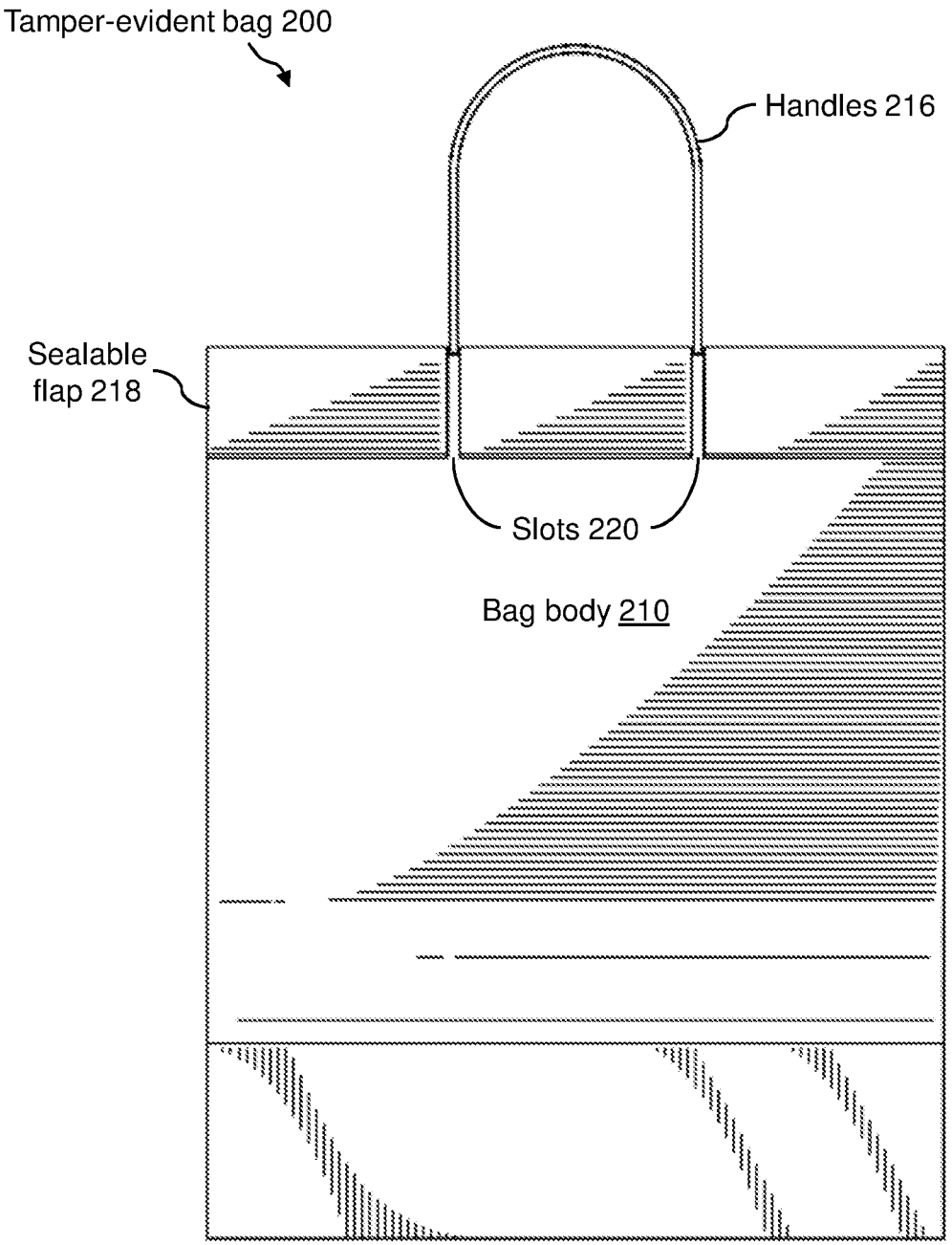
Figure 16:
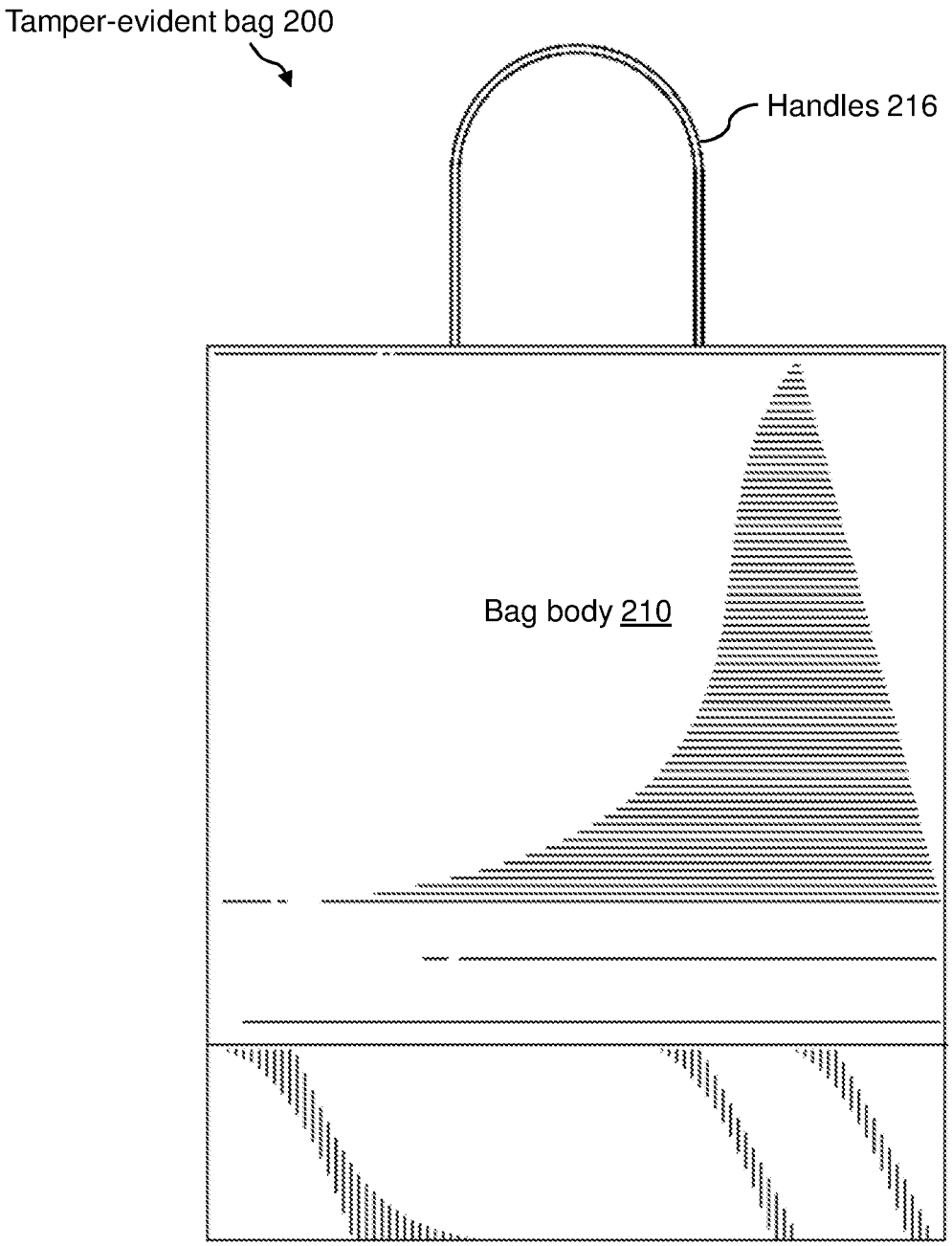
Figures 17, 18:
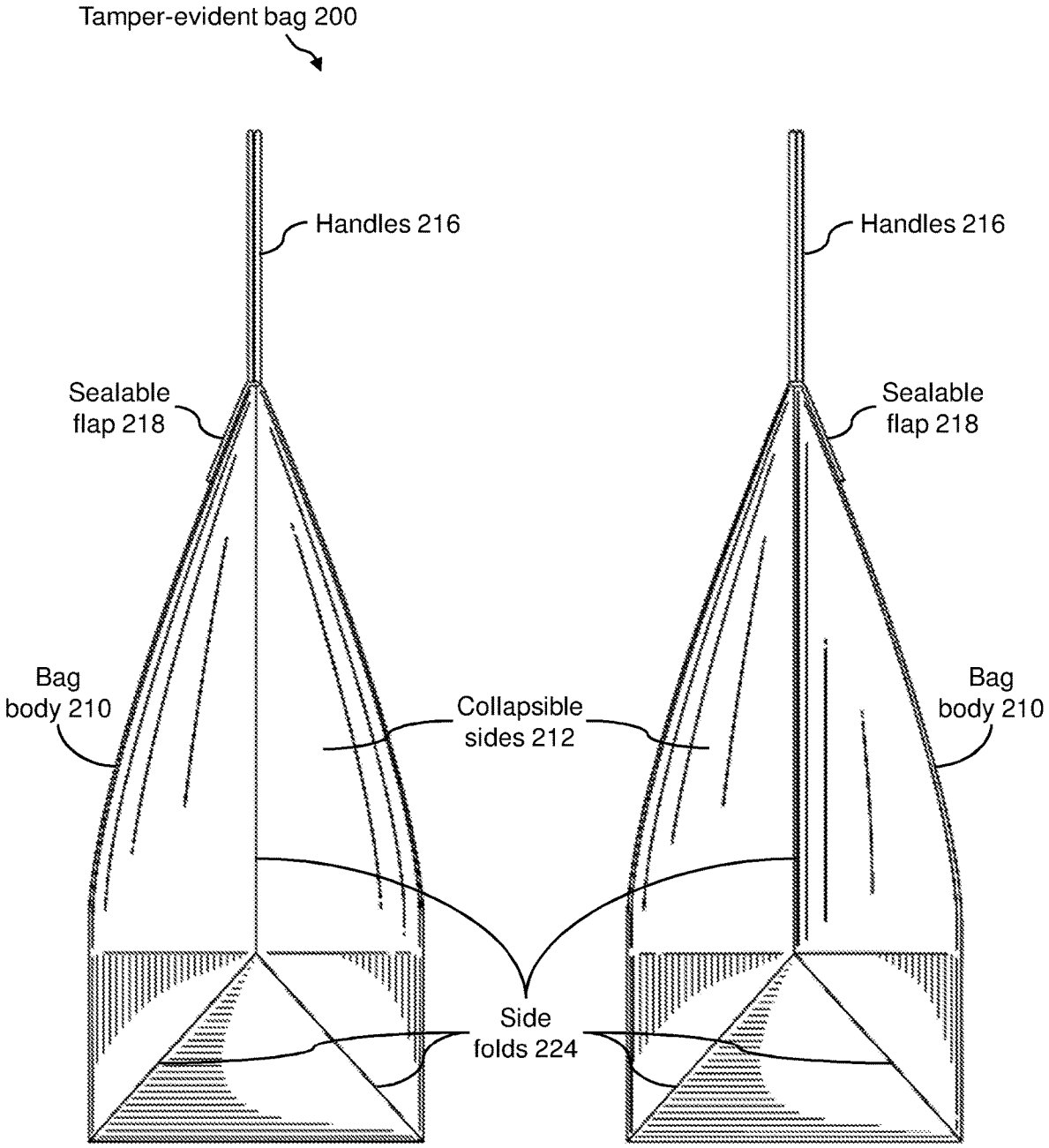
Figure 19:
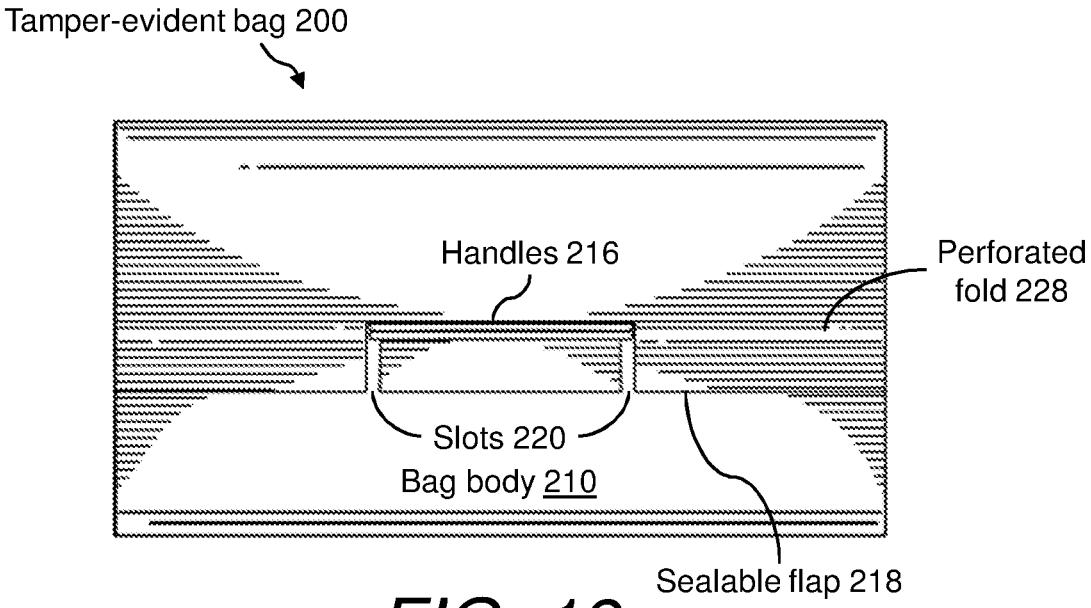
Figure 20:
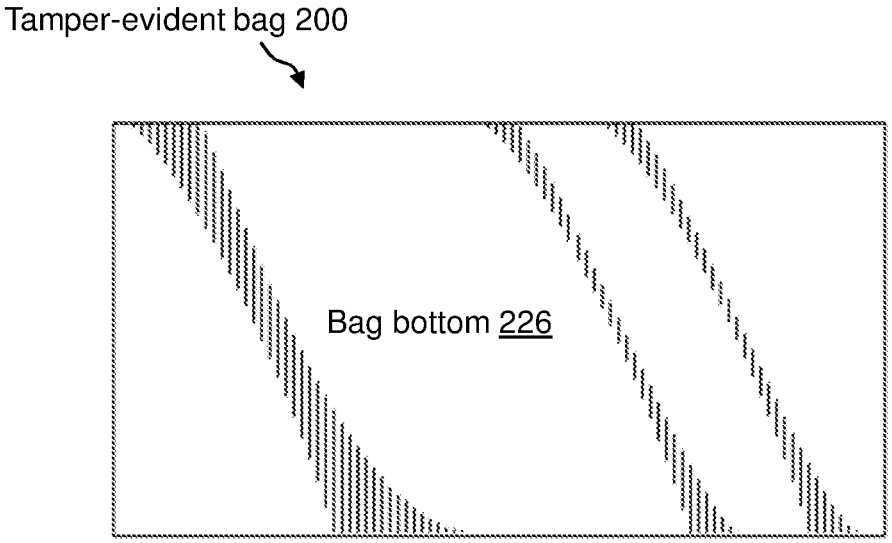
Figure 21:
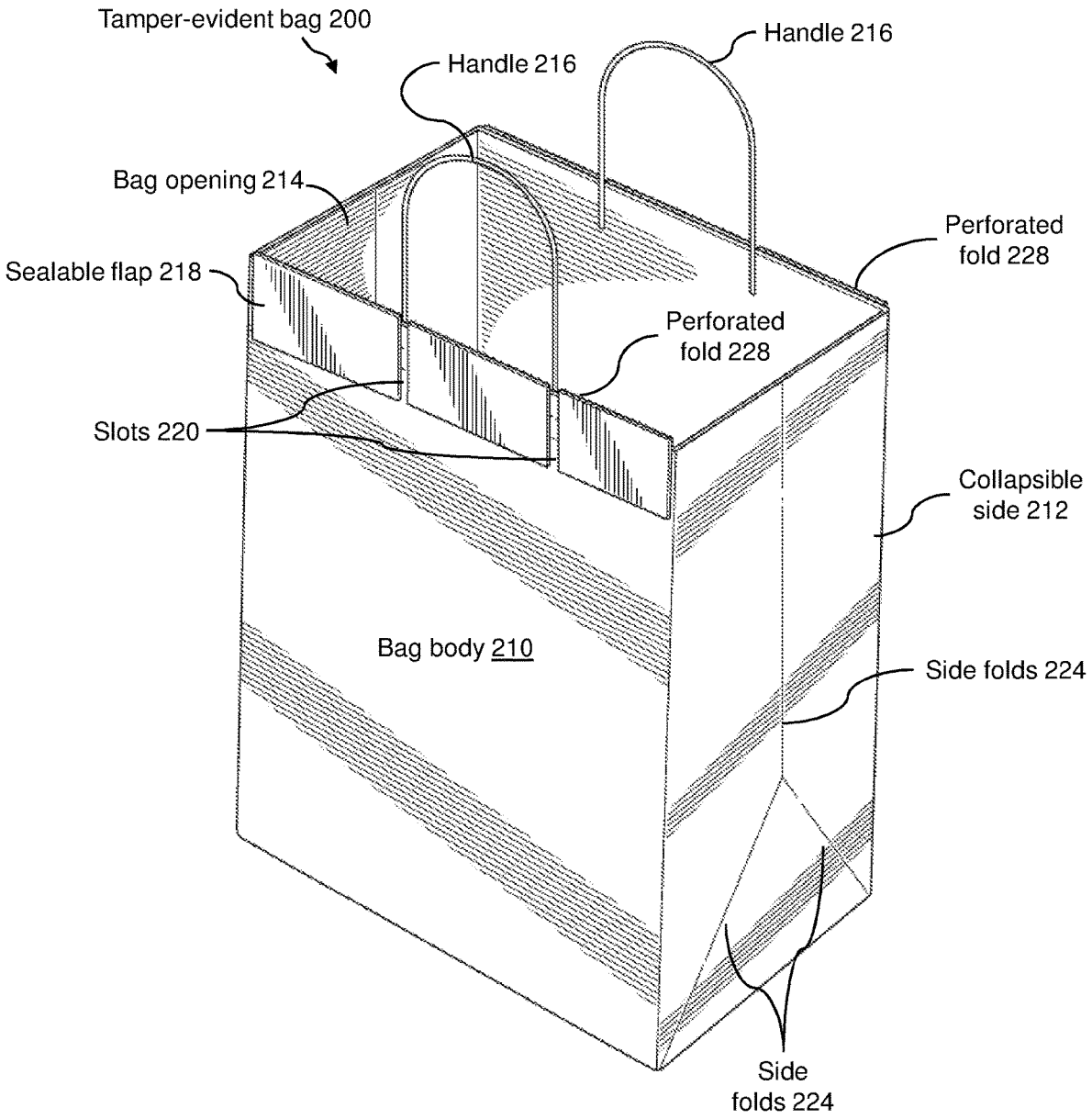
Figure 22:
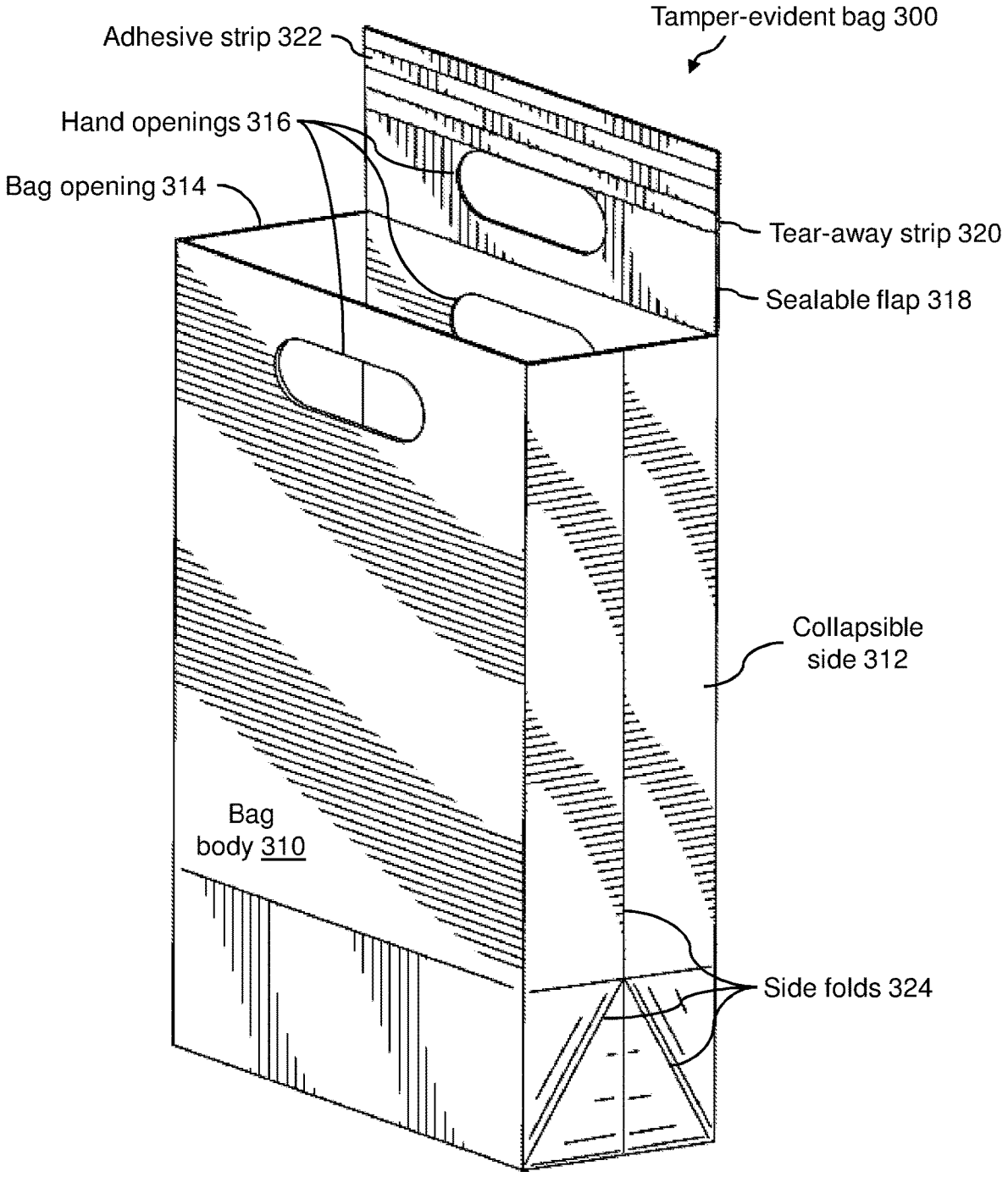
Figure 23:
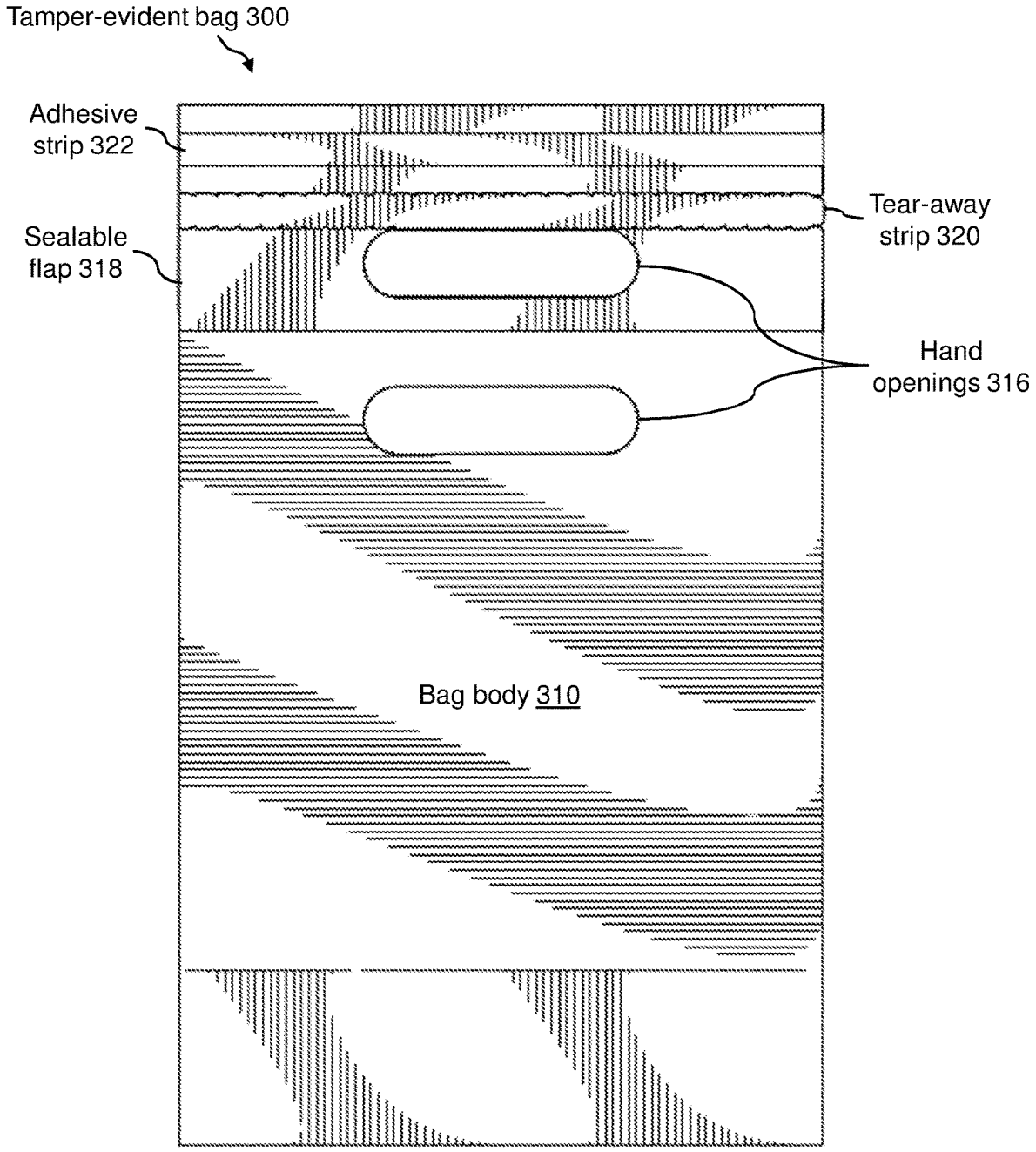
Figure 24:
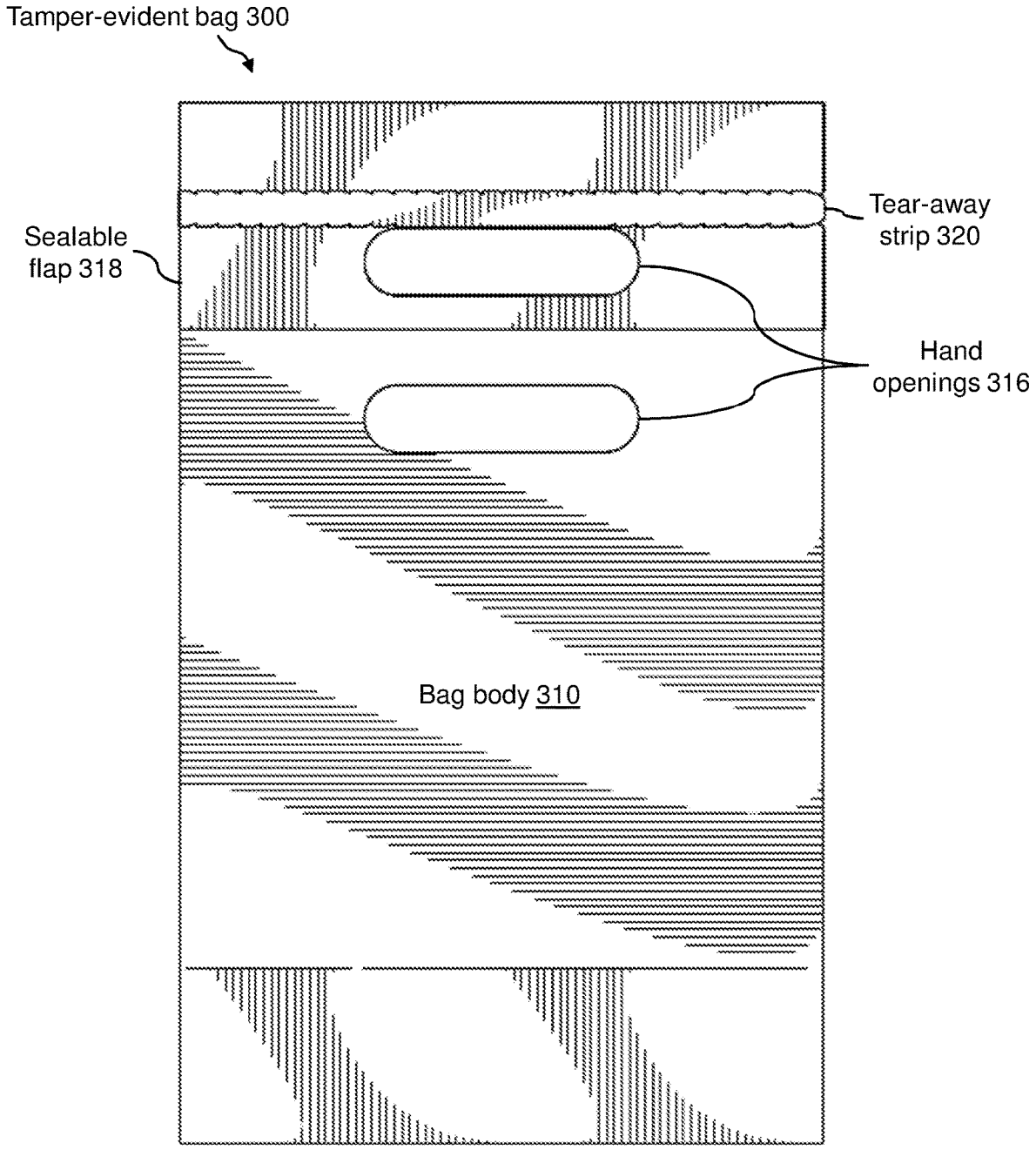
Figures 25, 26:
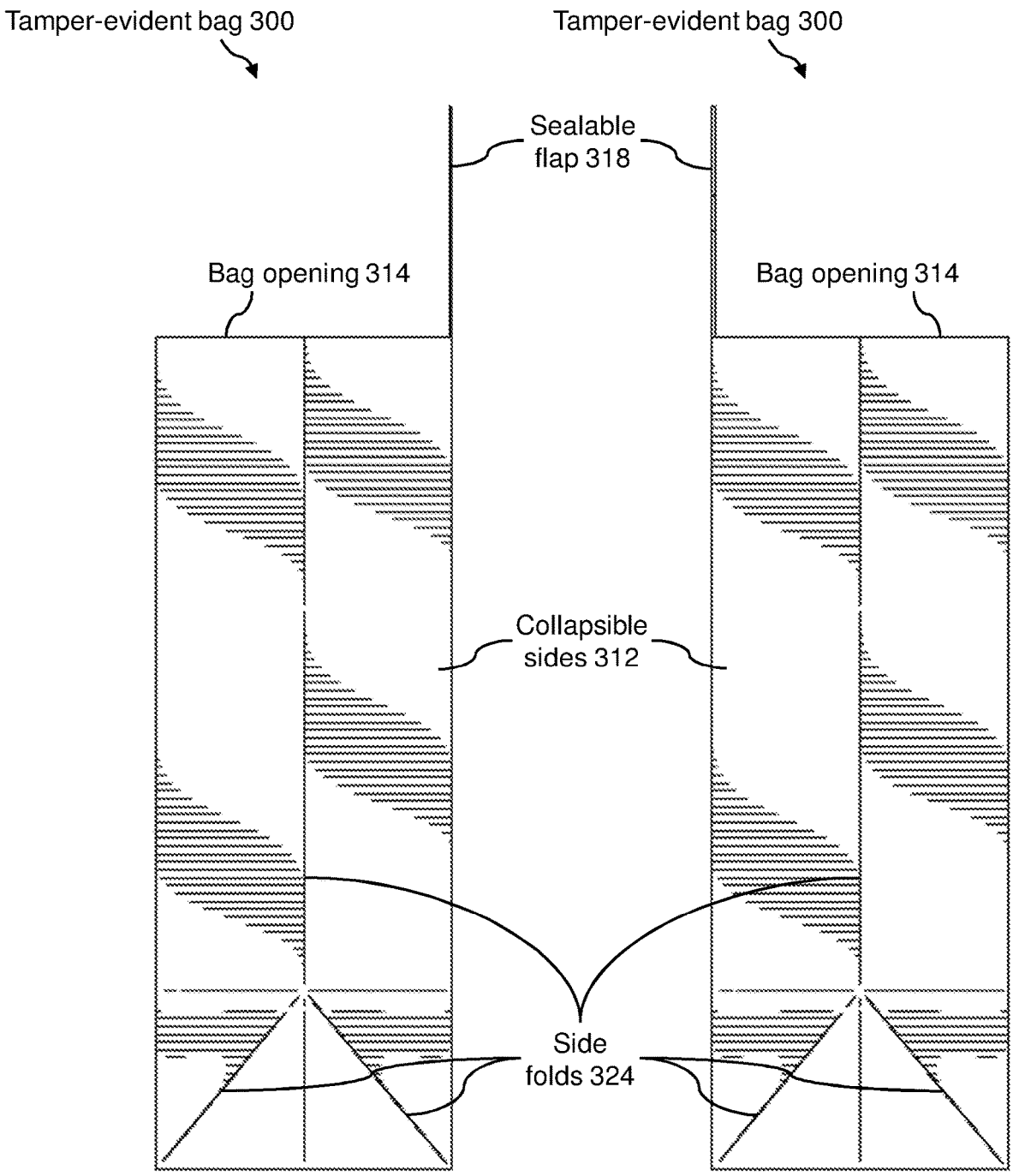
Figure 27:
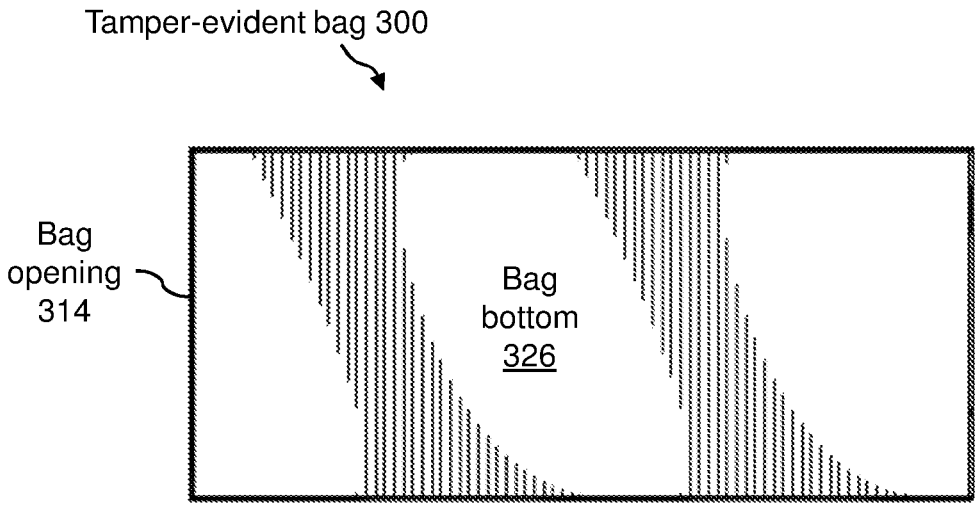
Figure 28:
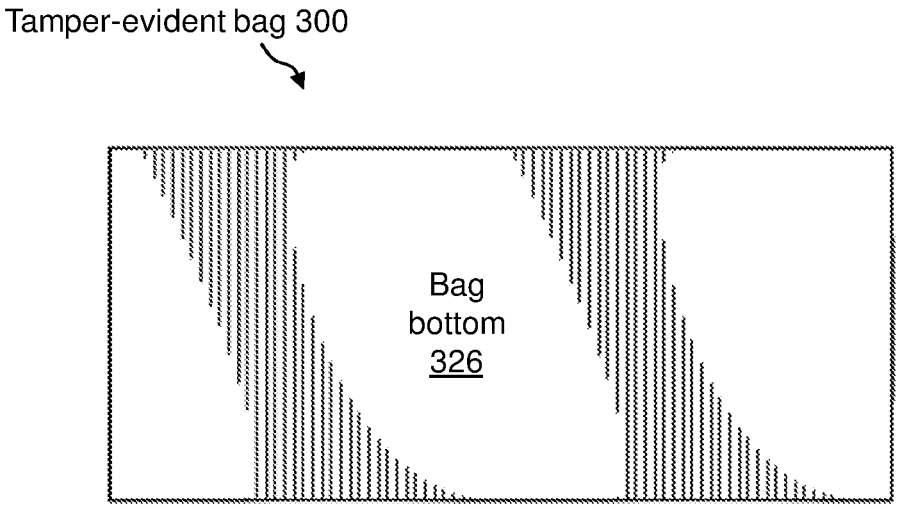
Figure 29:
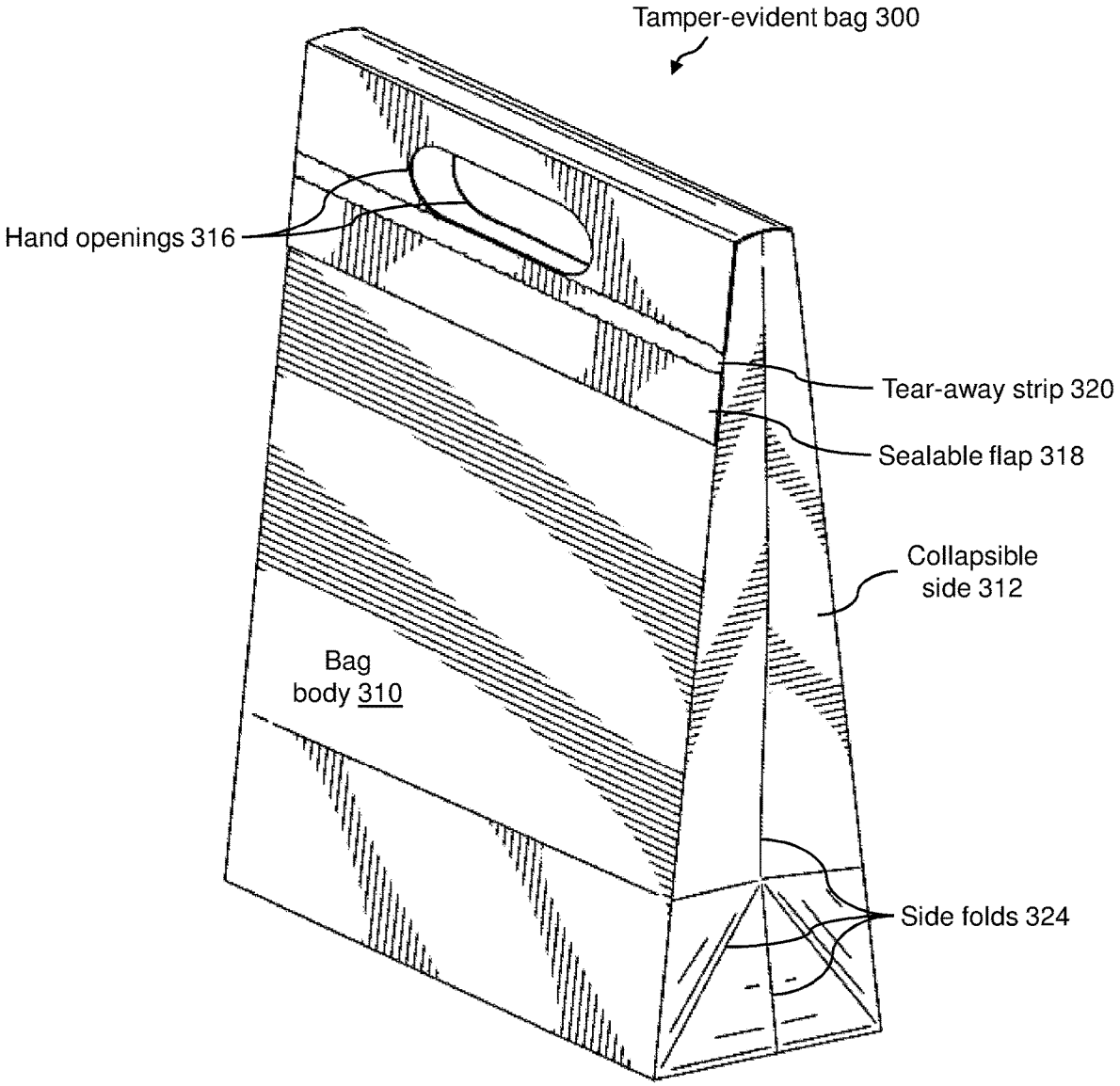
Figure 30:
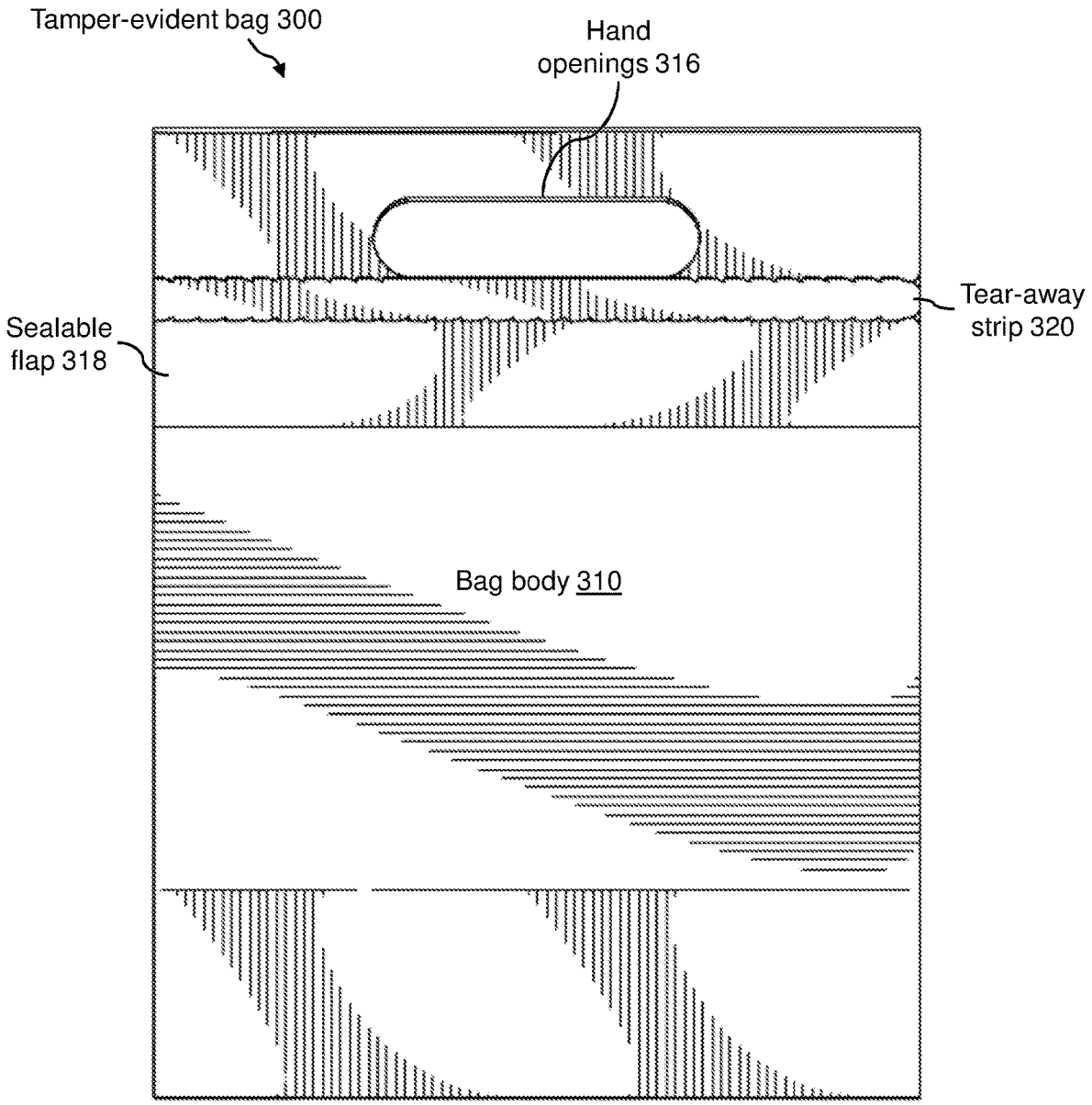
Figure 31:
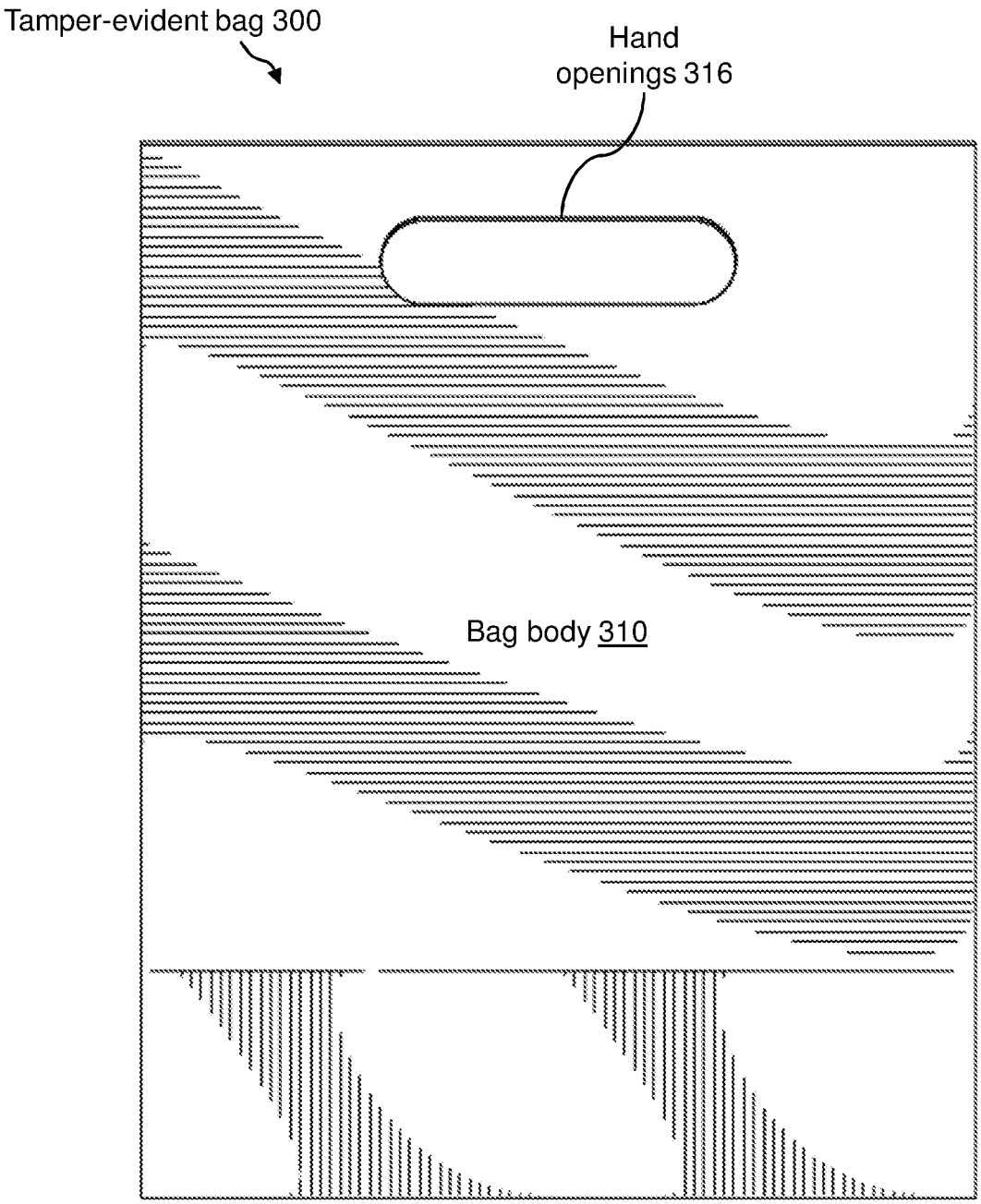
Figures 32, 33:
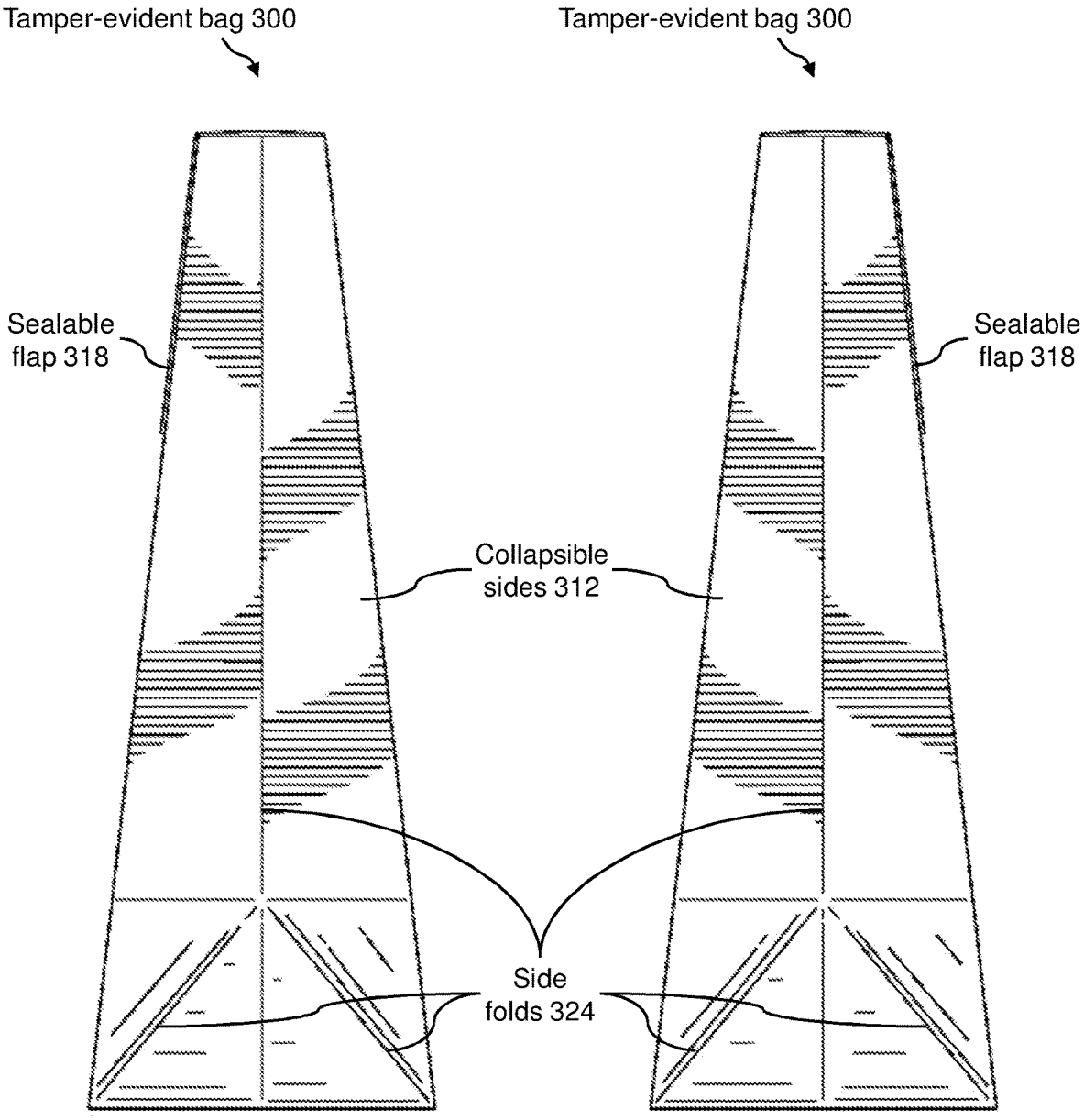
Figure 34:
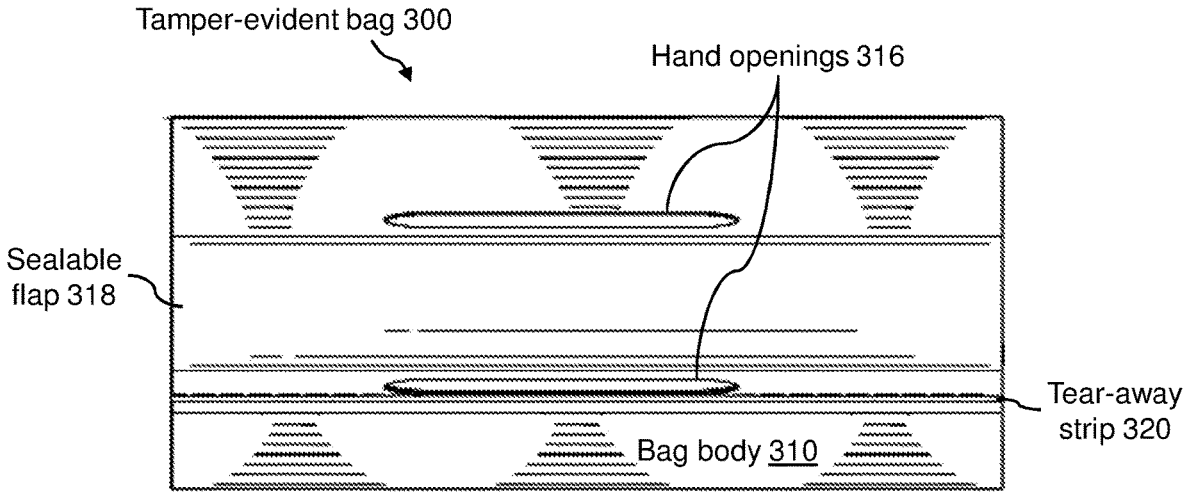
Figure 35:
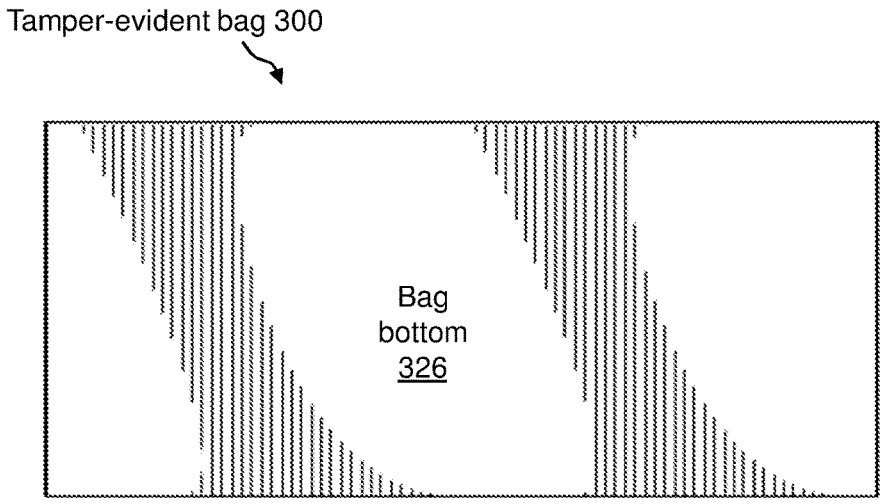
Figure 36:
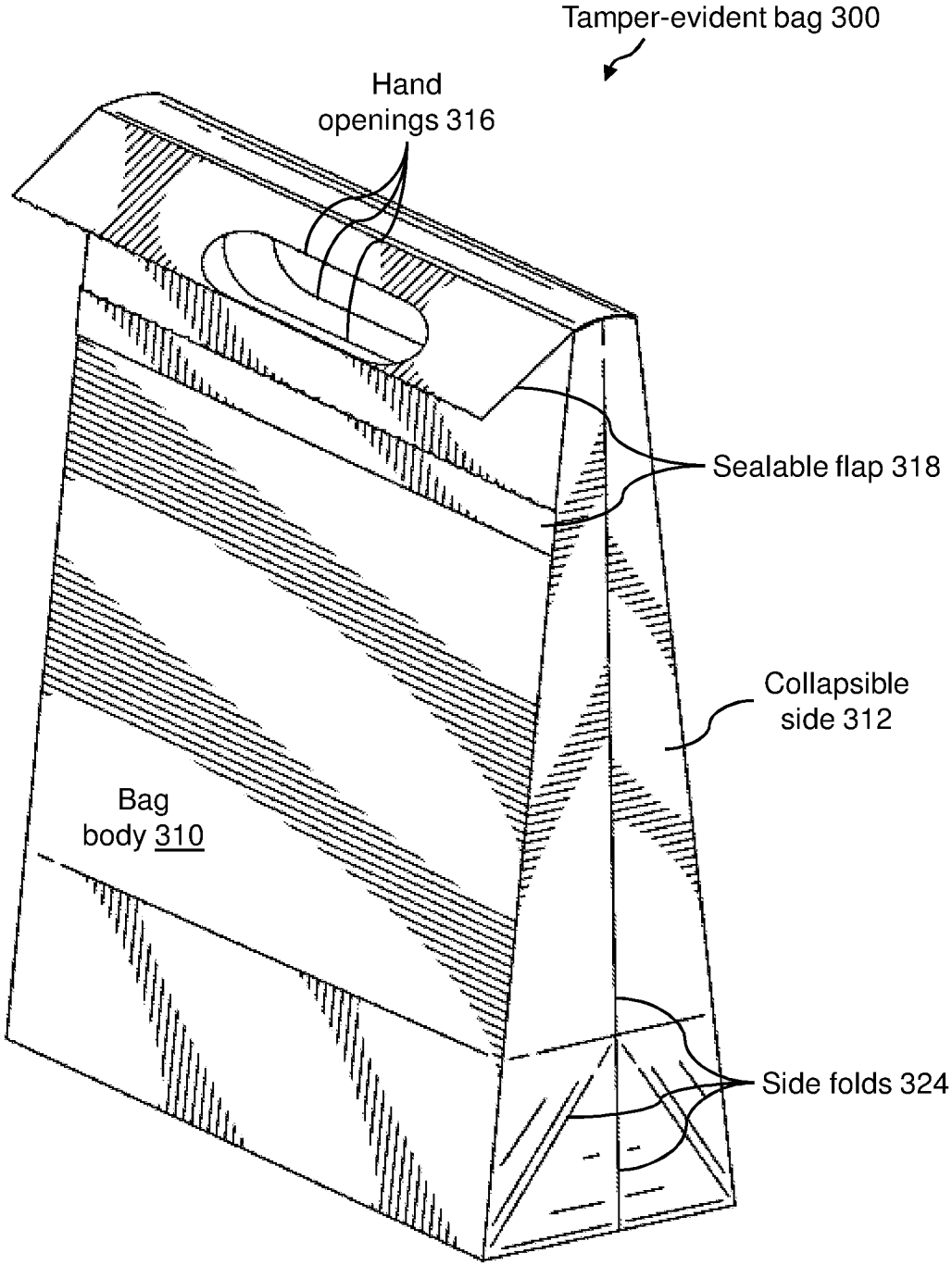
Figure 37:
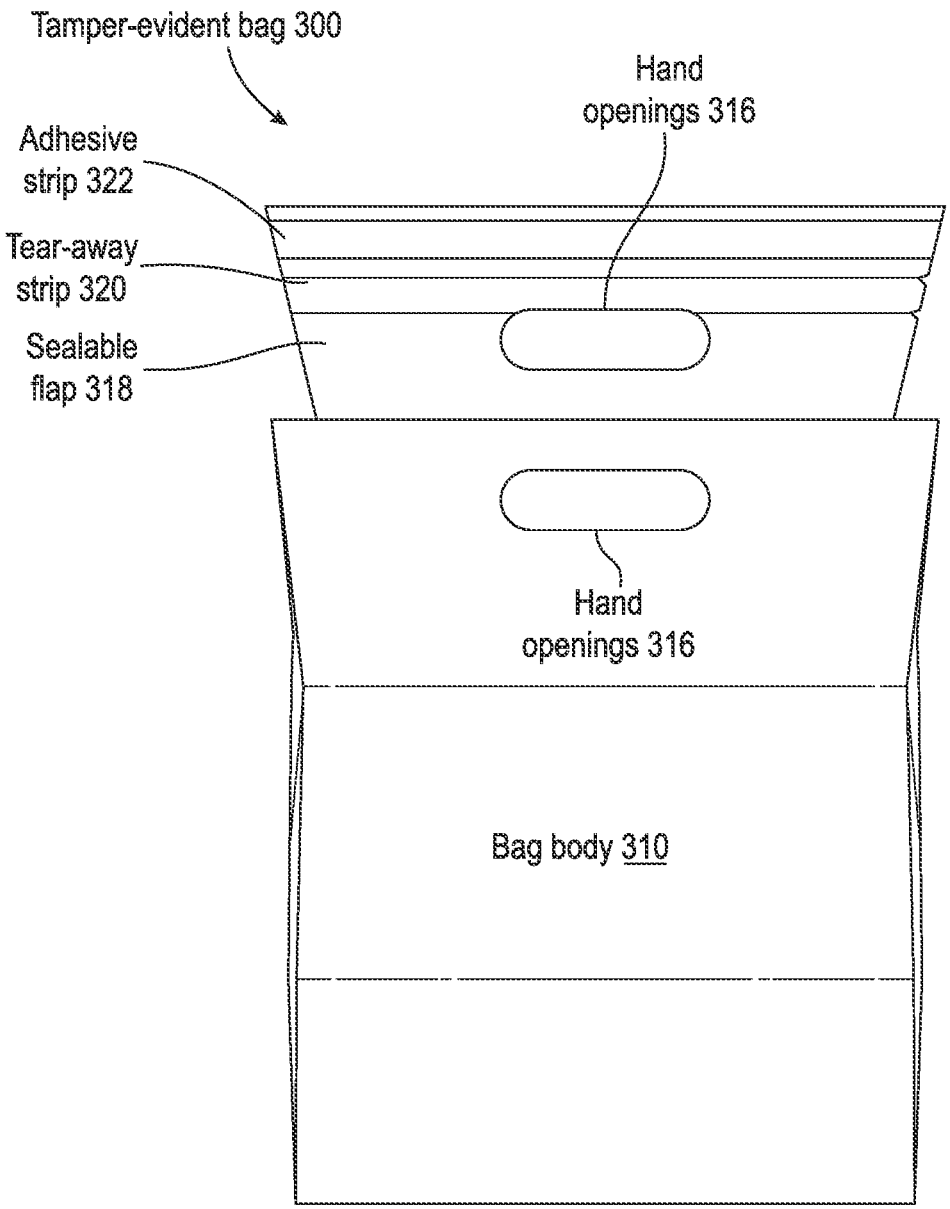
Figure 38:
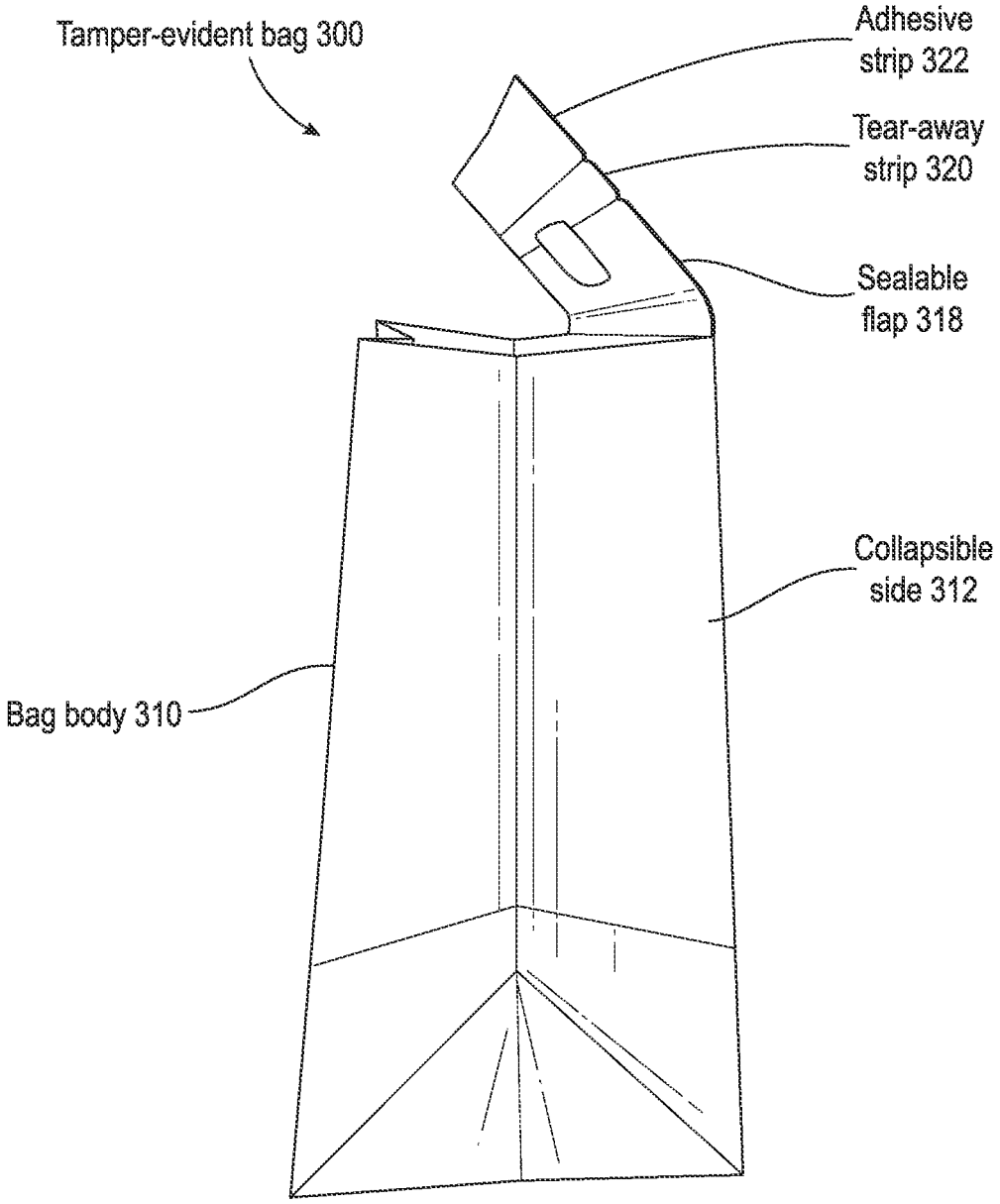

Having thus described the presently disclosed subject matter in general terms, reference will now be made to the accompanying Drawings, which are not necessarily drawn to scale, and wherein:

FIG. 1 illustrates a perspective view of an example of the presently disclosed tamper-evident bag seal partially installed on a bag;

FIG. 2 illustrates a perspective view of an example of the presently disclosed tamper-evident bag seal fully installed on a bag and in the sealed or untampered with state;

FIG. 3 illustrates a perspective view of an example of the presently disclosed tamper-evident bag seal installed on a bag and in the opened or tampered with state;

FIG. 4, FIG. 5, and FIG. 6 illustrate plan views of examples of different sized tamper-evident bag seals for use with different sized bags;

FIG. 7 illustrates a perspective view of an example of the presently disclosed tamper-evident bags, wherein the tamper-evident bag is in the opened and unsealed state;

FIG. 8, FIG. 9, FIG. 10, FIG. 11, FIG. 12, and FIG. 13 illustrate a front view, a back view, a first side view, a second side view, a top view, and a bottom view, respectively, of the tamper-evident bag shown in FIG. 1 in the opened and unsealed state;

FIG. 14 illustrates a perspective view of the tamper-evident bag shown in FIG. 1 in the closed and sealed state;

FIG. 15, FIG. 16, FIG. 17, FIG. 18, FIG. 19, and FIG. 20 illustrate a front view, a back view, a first side view, a second side view, a top view, and a bottom view, respectively, of the tamper-evident bag shown in FIG. 1 in the closed and sealed state;

FIG. 21 illustrates a perspective view of the tamper-evident bag shown in FIG. 14 showing a tamper-evident condition;

FIG. 22 illustrates a perspective view of another example of the presently disclosed tamper-evident bag in accordance with an embodiment of the invention, wherein the tamper-evident bag is in the opened and unsealed state;

FIG. 23, FIG. 24, FIG. 25, FIG. 26, FIG. 27, and FIG. 28 illustrate a front view, a back view, a first side view, a second side view, a top view, and a bottom view, respectively, of the tamper-evident bag shown in FIG. 22 in the opened and unsealed state;

FIG. 29 illustrates a perspective view of the tamper-evident bag shown in FIG. 22 in the closed and sealed state;

FIG. 30, FIG. 31, FIG. 32, FIG. 33, FIG. 34, and FIG. 35 illustrate a front view, a back view, a first side view, a second side view, a top view, and a bottom view, respectively, of the tamper-evident bag shown in FIG. 22 in the closed and sealed state;

FIG. 36 illustrates a perspective view of the tamper-evident bag shown in FIG. 22 in the partially opened state and showing a tamper-evident condition; and FIG. 37 and FIG. 38 show various photos of an example of the tamper-evident bag shown in FIG. 22 through FIG. 36.

DETAILED DESCRIPTION

The presently disclosed subject matter now will be described more fully hereinafter with reference to the accompanying Drawings, in which some, but not all embodiments of the presently disclosed subject matter are shown. Like numbers refer to like elements throughout. The presently disclosed subject matter may be embodied in many different forms and should not be construed as limited to the embodiments set forth herein; rather, these embodiments are provided so that this disclosure will satisfy applicable legal requirements. Indeed, many modifications and other embodiments of the presently disclosed subject matter set forth herein will come to mind to one skilled in the art to which the presently disclosed subject matter pertains having the benefit of the teachings presented in the foregoing descriptions and the associated Drawings. Therefore, it is to be understood that the presently disclosed subject matter is not to be limited to the specific embodiments disclosed and that modifications and other embodiments are intended to be included within the scope of the appended claims.

In some embodiments, the presently disclosed subject matter provides a tamper-evident bag seal and/or tamper-evident bags and methods.

In some embodiments, the presently disclosed tamper-evident bag seal is provided as an addon device to an existing bag. Once installed on the bag, the presently disclosed tamper-evident bag seal provides a tamper evident sign or indicator that shows that the bag has been opened and potentially that the contents of the bag have been tampered with. The tamper-evident bag seal may be, for example, a paper or paperboard panel (or any other suitable material)

that folds over the handles of an existing bag and is secured to the sides of the bag. The tamper-evident bag seal may be provided in different sizes (e.g., small, medium and large) that correlate to different size bags and/or bag handle sizes. The tamper-evident bag seal may be used with bags having several different handle configurations, such as, but not limited to, plastic, plastic rope, plastic ribbon, injection molded plastic, paper, and rope handles.

The presently disclosed tamper-evident bag seal may include, for example, a fold-over panel or card that has double sided tape on each side of the fold-over card. Further, the fold of the fold-over card may be perforated to provide a tear line. The fold-over card may also include an opening for fitting over the handles of the bag. After the contents are placed into the bag, the fold-over card that fits the bag (e.g., small, medium and large) fits over the handles, the adhesive liner may then be removed from each side of the card, and then the sides of fold-over card may be folded over and secured to the sides of the bag. Accordingly, the tamper-evident bag seal is used to seal the bag until the handles are pulled in opposite directions tearing the card at the perforation and allowing access to the contents.

In some embodiments, the presently disclosed subject matter provides tamper-evident bags and methods. In some embodiments, the presently disclosed tamper-evident bags can be a food carry out/to-go bag, carry bag, hand bag, shopping bag, or gift bag formed, for example, of paper, plastic, and/or cardboard.

In one embodiment of the presently disclosed tamper-evident bags, the tamper-evident bag includes a sealable flap for securing the bag in the closed state. Further, the tamper-evident bag includes a perforated fold, seam, or line along the sealable flap that is the mechanism for opening the bag. Namely, to open the sealed flap and thereby open the bag, a user must tear across the perforated fold, seam, or line. The compromised perforated fold, seam, or line provides easy visual evidence that the bag has been opened or tampered with. Accordingly, in this embodiment, the perforated fold, seam, or line is the tamper-evident feature of the tamper-evident bag.

In another embodiment of the presently disclosed tamper-evident bags, the tamper-evident bag includes a sealable flap for securing the bag in the closed state. Further, the tamper-evident bag includes a tear-away strip along the sealable flap that is the mechanism for opening the bag. Namely, to open the sealed flap and thereby open the bag, a user must tear away the tear-away strip. The compromised tear-away strip provides easy visual evidence that the bag has been opened or tampered with. Accordingly, in this embodiment, the tear-away strip is the tamper-evident feature of the tamper-evident bag.

Referring now to FIG. 1 is a perspective view of an example of the presently disclosed tamper-evident bag seal 100 that is partially installed on a bag 150. FIG. 2 shows tamper-evident bag seal 100 fully installed on bag 150 and in the sealed or untampered with state. FIG. 3 show tamper-evident bag seal 100 installed on bag 150 and in the opened or tampered with state.

In one example, tamper-evident bag seal 100 may be made of 0.012-inch thick cardboard (or any other suitable material and/or thickness). Tamper-evident bag seal 100 may include two panels or flaps 110 (e.g., 110*a*, 110*b*) joined at a perforated fold 112, wherein perforated fold 112 may provide a tear line. A handle opening 114 may be provided along perforated fold 112 and at about the center of perforated fold 112. A strip of double-sided tape 116, or other suitable adhesive technique or mechanism (see FIG. 4, FIG. 5, and FIG. 6), may be provided on the bag facing side of each of the two panels or flaps 110. Optionally, a fold 118 may be provided about midway of each of the two panels or flaps 110. Tamper-evident bag seal 100 may be provided as an addon device to an existing bag, such as bag 150 that has bag handles 152. Bag handles 152 may be, for example, plastic, plastic rope, plastic ribbon, injection molded plastic, paper, rope, or other suitable type handles.

Perforated fold 112 may be a perforated fold, seam, or line along tamper-evident bag seal 100 that is the mechanism for opening bag 150 and wherein the perforated fold, seam, or line is also the tamper-evident feature of tamper-evident bag seal 100.

In operation, (1) bag 150 is provided with some contents already inside, (2) tamper-evident bag seal 100 is provided, (3) the two bag handles 152 of bag 150 are brought together, (4) handle opening 114 of tamper-evident bag seal 100 is fitted down over the bag handles 152 of bag 150, (5) tamper-evident bag seal 100 is folded over bag 150 at perforated fold 112, (6) one flap 110 (e.g., flap 110*a*) is adhered to one side of bag 150 via a strip of double-sided tape 116, and (7) the other flap 110 (e.g., flap 110*b*) is adhered to the other side of bag 150 via a strip of double-sided tape 116. Accordingly, tamper-evident bag seal 100 is used to seal bag 150 (see FIG. 2) until its bag handles 152 are pulled in opposite directions tearing tamper-evident bag seal 100 at perforated fold 112 and allowing access to the contents (see FIG. 3).

Referring now to FIG. 4, FIG. 5, and FIG. 6 is plan views of examples of different sized tamper-evident bag seals 100 for use with different sized bags. Generally, tamper-evident bag seal 100 has an overall length L and an overall width W. Further, each panel or flap 110 has a width w. Further, handle opening 114 has a length 11 and a width w1. Further, double-sided tape 116 has a width w2. Double-sided tape 116 may be, for example, 4 ply tape. Additionally, the length of double-sided tape 116 may extend a distance beyond each end of tamper-evident bag seal 100, in a non-limiting example, about 0.25 inches.

In the example shown in FIG. 4, tamper-evident bag seal 100 may be designed to fit on a bag about 8-inch to 10-inch wide with handles. In this example, tamper-evident bag seal 100 may have an overall length L of about 10 inches and an overall width W of about 6 inches. Further, each panel or flap 110 has a width w of about 3 inches and wherein if fold 118 is present it may be about midway of the 3-inch flap 110. Further, handle opening 114 may have a length 11 of about 4.75 inches and a width w1 of about 0.625 inches. Further, double-sided tape 116 may have a width w2 of from about 0.5 inches to about 0.75 inches. Additionally, perforated fold 112 may be about 0.124-inch×0.0625-inch perforation, or other suitable dimension.

In the example shown in FIG. 5, tamper-evident bag seal 100 may be designed to fit on a bag about 12-inch to 14-inch wide with handles. In this example, the dimensions of tamper-evident bag seal 100 may be substantially the same as those described hereinabove with reference to FIG. 4 except that the overall length L may be about 14 inches.

In the example shown in FIG. 6, tamper-evident bag seal 100 may be designed to fit on a bag about 15-inch to 19-inch wide with handles. In this example, the dimensions of tamper-evident bag seal 100 are substantially the same as those described hereinabove with reference to FIG. 4 except that the overall length L may be about 19 inches.

In the examples shown in FIG. 4, FIG. 5, and FIG. 6, tamper-evident bag seal 100 may be cut to length to more precisely fit any particular bag. Tamper-evident bag seal 100 of FIG. 4 may be considered the "small" size. Tamper-evident bag seal 100 of FIG. 5 may be considered the "medium" size. Tamper-evident bag seal 100 of FIG. 6 may be considered the "large" size. However, the examples of tamper-evident bag seal 100 shown in FIG. 4, FIG. 5, and FIG. 6 are exemplary only. Tamper-evident bag seal 100 may be provided with any dimensions, e.g., larger or smaller than the examples shown in FIG. 4, FIG. 5, and FIG. 6.

Referring now to FIG. 7 through FIG. 13 is various views of an example of the presently disclosed tamper-evident bags; namely, a tamper-evident bag 200 shown in the opened and unsealed state. Namely, FIG. 7, FIG. 8, FIG. 9, FIG. 10, FIG. 11, FIG. 12, and FIG. 13 show a perspective view, a front view, a back view, a first side view, a second side view, a top view, and a bottom view, respectively, of tamper-evident bag 200 in the opened and unsealed state.

Tamper-evident bag 200 includes a bag body 210 that may have collapsible sides 212, a bag opening 214 at the top of bag body 210, one or more hoop- or loop-style handles 216 arranged with respect to bag opening 214, a sealable flap 218 arranged with respect to one edge of bag opening 214, a pair of slots 220 in sealable flap 218 and arranged with respect to handles 216, an adhesive strip 222 on the side of bag body 210 opposite sealable flap 218 and near bag opening 214, a plurality of side folds 224 for forming collapsible sides 212, and a bag bottom 226. In various embodiments, adhesive strip 222 can be on bag body 210, or on sealable flap 218, or on both bag body 210 and sealable flap 218.

Additionally, tamper-evident bag 200 may include a perforated fold 228, which is the attachment interface of sealable flap 218 to the edge of bag body 210 at bag opening 214. Perforated fold 228 is the tamper-evident feature of tamper-evident bag 200.

Referring now to FIG. 14 through FIG. 20 is various views of tamper-evident bag 200 shown in the closed and sealed state. Namely, FIG. 14, FIG. 15, FIG. 16, FIG. 17, FIG. 18, FIG. 19, and FIG. 20 show a perspective view, a front view, a back view, a first side view, a second side view, a top view, and a bottom view, respectively, of tamper-evident bag 200 in the closed and sealed state.

Tamper-evident bag 200 can be, for example, a carry bag, hand bag, shopping bag, or gift bag. Tamper-evident bag 200 may be formed, for example, of paper, plastic, cardboard, and/or other suitable material. Further, tamper-evident bag 200 may be any size or dimensions, such as some number of inches or centimeters in length, some number of inches or centimeters in width, and some number of inches or centimeters in height.

In operation, a user may receive tamper-evident bag 200 in the opened and unsealed state as shown in FIG. 7 through FIG. 13. Next, a user places one or more items into tamper-evident bag 200, such as one or more carryout or to-go food containers. Next, a user brings together the two handles 216 such that the sides of bag opening 214 are also brought together as shown in FIG. 14 through FIG. 20. Next, sealable flap 218 is folded down and into contact with adhesive strip 222 on the side of bag body 210. In so doing, sealable flap 218 is affixed and held secure to the side of bag body 210. Further, when folding down sealable flap 218, slots 220 provide clearance for handles 216. If necessary, prior to pressing adhesive strip 222 of sealable flap 218 into contact with the side of bag body 210, the user may remove a protective strip (not shown) from over the adhesive strip 222 to expose the adhesive. FIG. 14 through FIG. 20 show tamper-evident bag 200 in the closed and sealed state. Additionally, FIG. 14 through FIG. 20 show tamper-evident bag 200 in a "secure" condition because perforated fold 228 is fully intact. That is, a "tamper-evident" condition is not present because perforated fold 228 has not been compromised.

Next and referring now to FIG. 21, to open tamper-evident bag 200, the user tears open perforated fold 228 to access the one or more items inside. As a result of tearing open perforated fold 228, a "tamper-evident" condition is now present and easily visible because perforated fold 228 has been compromised. In particular, any tearing of perforated fold 228 in full or in part is considered evidence of tampering. As seen in FIG. 21, for example, once tamper-evident bag 200 has been opened, after being sealed, portions of sealable flap 218 remains on the front portion and back portion of bag body 200, and perforated fold 228 is separated in half lengthwise along bag opening 214.

In summary and referring now to FIG. 7 through FIG. 21, in one embodiment of the presently disclosed tamper-evident bags, tamper-evident bag 200 may include a sealable flap 218 for securing tamper-evident bag 200 in the closed state. Further, tamper-evident bag 200 may include a perforated fold 228 along sealable flap 218, which is the mechanism for opening the bag. Namely, to open sealable flap 218 and thereby open tamper-evident bag 200, a user must tear across perforated fold 228. The compromised perforated fold 228 provides easy visual evidence that tamper-evident bag 200 has been opened or tampered with. Accordingly, in this embodiment, perforated fold 228 is the tamper-evident feature of tamper-evident bag 200.

Referring now to FIG. 22 through FIG. 28 is various views of an example of the presently disclosed tamper-evident bags; namely, a tamper-evident bag 300 shown in the opened and unsealed state. Namely, FIG. 22, FIG. 23, FIG. 24, FIG. 25, FIG. 26, FIG. 27, and FIG. 28 show a perspective view, a front view, a back view, a first side view, a second side view, a top view, and a bottom view, respectively, of tamper-evident bag 300 in the opened and unsealed state.

Tamper-evident bag 300 may include a bag body 310 that may have collapsible sides 312, a bag opening 314 at the top of bag body 310, a pair of hand openings 316 in bag body 310 and arranged with respect to bag opening 314, a sealable flap 318 arranged with respect to one edge of bag opening 314, another hand opening 316 in sealable flap 318, an adhesive strip 322 along the edge of sealable flap 318 farthest from bag opening 314, a plurality of side folds 324 for forming collapsible sides 312, and a bag bottom 326. In various embodiments, adhesive strip 322 can be on bag body 310, or on sealable flap 318, or on both bag body 310 and sealable flap 318.

Additionally, tamper-evident bag 300 may include a tear-away strip 320 that is integrated into sealable flap 318. Namely, tear-away strip 320 may be arranged between the attachment interface of sealable flap 318 to the edge of bag body 310 at bag opening 314 and adhesive strip 322 on sealable flap 318. Tear-away strip 320 is the tamper-evident feature of tamper-evident bag 300.

Referring now to FIG. 29 through FIG. 35 is various views of tamper-evident bag 300 shown in the closed and sealed state. Namely, FIG. 29, FIG. 30, FIG. 31, FIG. 32, FIG. 33, FIG. 34, and FIG. 35 show a perspective view, a front view, a back view, a first side view, a second side view, a top view, and a bottom view, respectively, of tamper-evident bag 300 in the closed and sealed state.

Referring now to FIG. 22 through FIG. 35, tamper-evident bag 300 may be, for example, a carry bag, hand bag, shopping bag, or gift bag. Tamper-evident bag 300 can be formed, for example, of paper, plastic, cardboard, and/or other suitable material. Further, tamper-evident bag 300 can be any size or dimensions, such as some number of inches or centimeters in length, some number of inches or centimeters in width, and some number of inches or centimeters in height.

In operation, a user receives tamper-evident bag 300 in the opened and unsealed state as shown in FIG. 22 through FIG. 28. Next, a user places one or more items into tamper-evident bag 300. Next, a user brings together the two hand openings 316 such that the sides of bag opening 314 are also brought together as shown in FIG. 29 through FIG. 35. Next, sealable flap 318 is folded down so that its hand opening 316 aligns with the hand openings 316 in bag body 310. Next, the user presses adhesive strip 322 of sealable flap 318 into contact with the side of bag body 310. If necessary, the user may remove a protective strip (not shown) from over the adhesive strip 322 to expose the adhesive. In so doing, sealable flap 318 is affixed and held secure to the side of bag body 310. If necessary, prior to pressing adhesive strip 322 of sealable flap 318 into contact with the side of bag body 310, the user may remove a protective strip (not shown) from over the adhesive strip 322 to expose the adhesive. FIG. 29 through FIG. 35 show tamper-evident bag 300 in the closed and sealed state. Additionally, FIG. 29 through FIG. 35 show tamper-evident bag 300 in a "secure" condition because tear-away strip 320 is fully intact. That is, a "tamper-evident" condition is not present because tear-away strip 320 has not been compromised.

Next and referring now to FIG. 36, to open tamper-evident bag 300, the user tears away the tear-away strip 320 to access the one or more items inside. In so doing, a lower portion of sealable flap 318 remains affixed to bag body 310, while the upper portion of sealable flap 318 is released and tamper-evident bag 3200 is now open. As a result of tearing away the tear-away strip 320, a "tamper-evident" condition is now present and easily visible because tear-away strip 320 has been compromised, as shown in FIG. 36. In particular, any tearing of tear-away strip 320 in full or in part is considered evidence of tampering.

Further to the example, FIG. 37 and FIG. 38 show photos of an example of tamper-evident bag 300 shown in FIG. 22 through FIG. 36.

In summary and referring now to FIG. 22 through FIG. 38, in another embodiment of the presently disclosed tamper-evident bags, tamper-evident bag 300 includes sealable flap 318 for securing tamper-evident bag 300 in the closed state. Further, tamper-evident bag 300 includes tear-away strip 320 along sealable flap 318 that is the mechanism for opening tamper-evident bag 300. Namely, to open sealable flap 318 and thereby open tamper-evident bag 300, a user must tear away the tear-away strip 320. The compromised tear-away strip 320 provides easy visual evidence that tamper-evident bag 300 has been opened or tampered with. Accordingly, in this embodiment, tear-away strip 320 is the tamper-evident feature of tamper-evident bag 300.

Following long-standing patent law convention, the terms "a," "an," and "the" refer to "one or more" when used in this application, including the claims. Thus, for example, reference to "a subject" includes a plurality of subjects, unless the context clearly is to the contrary (e.g., a plurality of subjects), and so forth.

Throughout this specification and the claims, the terms "comprise," "comprises," and "comprising" are used in a non-exclusive sense, except where the context requires otherwise. Likewise, the term "include" and its grammatical variants are intended to be non-limiting, such that recitation of items in a list is not to the exclusion of other like items that can be substituted or added to the listed items.

For the purposes of this specification and appended claims, unless otherwise indicated, all numbers expressing amounts, sizes, dimensions, proportions, shapes, formulations, parameters, percentages, quantities, characteristics, and other numerical values used in the specification and claims, are to be understood as being modified in all instances by the term "about" even though the term "about" may not expressly appear with the value, amount or range. Accordingly, unless indicated to the contrary, the numerical parameters set forth in the following specification and attached claims are not and need not be exact, but may be approximate and/or larger or smaller as desired, reflecting tolerances, conversion factors, rounding off, measurement error and the like, and other factors known to those of skill in the art depending on the desired properties sought to be obtained by the presently disclosed subject matter. For example, the term "about," when referring to a value can be meant to encompass variations of, in some embodiments±100%, in some embodiments±50%, in some embodiments±20%, in some embodiments±10%, in some embodiments±5%, in some embodiments±1%, in some embodiments±0.5%, and in some embodiments±0.1% from the specified amount, as such variations are appropriate to perform the disclosed methods or employ the disclosed compositions.

Further, the term "about" when used in connection with one or more numbers or numerical ranges, should be understood to refer to all such numbers, including all numbers in a range and modifies that range by extending the boundaries above and below the numerical values set forth. The recitation of numerical ranges by endpoints includes all numbers, e.g., whole integers, including fractions thereof, subsumed within that range (for example, the recitation of 1 to 5 includes 1, 2, 3, 4, and 5, as well as fractions thereof, e.g., 1.5, 2.25, 3.75, 4.1, and the like) and any range within that range.

Although the foregoing subject matter has been described in some detail by way of illustration and example for purposes of clarity of understanding, it will be understood by those skilled in the art that certain changes and modifications can be practiced within the scope of the appended claims.

That which is claimed:

1. A tamper-evident bag seal comprising:

a body having a length and a width, the body comprising a first flap and a second flap with the first and second flaps each having a bag facing side and an outward facing side;

a perforated fold between the first flap and the second flap;

a handle opening provided along the perforated fold and between the first flap and the second flap, the handle opening configured for receiving handles of a bag therethrough;

a first adhesive strip on the bag facing side of the first flap and a second adhesive strip on the bag facing side of the second flap, the first and second adhesive strips configured to secure the respective first and second flaps to respective first and second sides of the bag, wherein in its manufactured state the first and second adhesive strips have a length that extends a distance that is longer than the length of the body of the tamper-evident seal such that a portion of the first and second adhesive strips extend beyond at least one end of the body of tamper-evident bag seal; and wherein the bag facing side of the first flap is configured to be secured to a first side of a bag and the bag facing side of the second flap is configured to be secured to a second side of the bag with the handles of the bag extending through the handle opening between the first flap and the second flap.

2. The tamper-evident bag seal of claim 1, wherein the perforated fold comprises at least one of a fold, a seam or a line that is perforated and operates a mechanism for opening a bag once the tamper-evident seal is secured on the first and second sides of the bag with the handles of the bag extending through the handle opening.

3. The tamper-evident bag seal of claim 2, wherein the perforated fold comprises a tamper-evident feature.

4. The tamper-evident bag seal of claim 1, wherein the first and second adhesive strips comprise double-sided tape.

5. The tamper-evident bag seal of claim 1, wherein the portions of the first and second adhesive strips that extends beyond the ends of the body of the tamper-evident bag seal extend past the ends about 0.25 inches.

6. The tamper-evident bag seal of claim 1, wherein the first flap comprises a fold about midway of the first flap and the second flap comprises a fold about midway of the second flap.

7. The tamper-evident bag seal of claim 1, wherein the width and length of the body of the tamper-evident bag seal is such that when installed upon a bag to be sealed, the installed tamper evident bag seal covers an entire opening of the bag.

* * * * *